US007830355B2

(12) United States Patent
Hirakata et al.

(10) Patent No.: US 7,830,355 B2
(45) Date of Patent: Nov. 9, 2010

(54) LIQUID CRYSTAL DISPLAY DEVICE

(75) Inventors: Junichi Hirakata, Chiba (JP); Kikuo Ono, Mobara (JP); Akira Shingai, Chiba (JP)

(73) Assignees: Hitachi, Ltd., Tokyo (JP); Hitachi Device Engineering Co., Ltd, Chiba-ken (JP)

( * ) Notice: Subject to any disclaimer, the term of this patent is extended or adjusted under 35 U.S.C. 154(b) by 1433 days.

(21) Appl. No.: 11/245,179

(22) Filed: Oct. 7, 2005

(65) Prior Publication Data

US 2006/0038771 A1 Feb. 23, 2006

Related U.S. Application Data

(63) Continuation of application No. 09/987,595, filed on Nov. 15, 2001, now Pat. No. 7,161,577.

(30) Foreign Application Priority Data

Nov. 30, 2000 (JP) ..... 2000-365138
May 30, 2001 (JP) ..... 2001-162392
Aug. 30, 2001 (JP) ..... 2001-261777

(51) Int. Cl.
*G09G 3/36* (2006.01)

(52) U.S. Cl. ..... 345/102; 345/87; 345/103

(58) Field of Classification Search ..... 345/87–100, 345/201, 102, 103
See application file for complete search history.

(56) References Cited

U.S. PATENT DOCUMENTS 5,347,201 A 9/1994 Liang et al.
5,717,422 A 2/1998 Fergason
5,796,382 A 8/1998 Beeteson
5,818,172 A 10/1998 Lee
6,198,464 B1 3/2001 Ota et al.
6,255,781 B1 * 7/2001 Tsumura ..... 315/169.1
6,373,397 B1 4/2002 Song
6,570,554 B1 5/2003 Makino et al.

(Continued)

FOREIGN PATENT DOCUMENTS

EP 0685831 A1 5/1995

(Continued)

OTHER PUBLICATIONS

Office Action from Chinese Patent Office dated May 23, 2008 for Chinese Patent Application No. 2005100559488, in Chinese language with partial English translation.

(Continued)

*Primary Examiner*—Nitin Patel
(74) *Attorney, Agent, or Firm*—Stites & Harbison PLLC; Juan Carlos A. Marquez, Esq.

(57) ABSTRACT

In a liquid crystal display device having a backlight, the backlight has a first state which outputs a first amount of light and a second state which generates a second amount of light and the time for the first state and the time for the second state are controlled. Due to such a constitution, the liquid crystal display device can display clear motion picture images in spite of a simple constitution thereof. Further, the liquid crystal display device can display clear and bright motion picture images.

4 Claims, 26 Drawing Sheets

U.S. PATENT DOCUMENTS

| | | | | |
|---|---|---|---|---|
| 6,703,993 | B2 | 3/2004 | Miura et al. | |
| 7,038,391 | B2 * | 5/2006 | Tsumura | 315/169.1 |
| 7,233,304 | B1 | 6/2007 | Aratani | |
| 2002/0000960 | A1 | 1/2002 | Yoshihara et al. | |
| 2002/0130830 | A1 | 9/2002 | Park | |
| 2003/0001983 | A1 | 1/2003 | Nose | |
| 2003/0209991 | A1 * | 11/2003 | Tsumura | 315/169.3 |

FOREIGN PATENT DOCUMENTS

| | | | |
|---|---|---|---|
| EP | 1014332 | A2 | 12/1999 |
| EP | 1 111 578 | A1 | 5/2000 |
| EP | 1117028 | A2 | 5/2000 |
| EP | 1164566 | A2 | 6/2001 |
| EP | 1548563 | A1 | 4/2004 |
| JP | 7-13128 | | 6/1993 |
| JP | 2000-275604 | A | 3/1999 |
| WO | WO 91/10223 | | 11/1990 |
| WO | WO 93/13514 | | 12/1992 |
| WO | WO 95/01701 | | 6/1994 |
| WO | WO 97/31359 | | 2/1997 |
| WO | WO 00/68926 | | 5/2000 |

OTHER PUBLICATIONS

European Search Report dated Feb. 3, 2003.
Office Action from the European Patent Office dated Nov. 21, 2008.
The Extended European Search Report, dated Jul. 7, 2009.
dpANS SCSI Primary Commands-3 (SPC-3), Project T10/1416-D Revision 23, Internet Citation, dated May 4, 2005.

* cited by examiner

LIQUID CRYSTAL DISPLAY DEVICE

This application is a Continuation application of U.S. Ser. No. 09/987,595 filed on Nov. 15, 2001 now U.S. Pat. No 7,161,577. Priority is claimed based on U.S. Ser. No. 09/987, 595 filed on Nov. 15, 2001, which claims priority to Japanese Patent Application Nos. 2000-365138, 2001-162392 and 2001-261777 filed on Nov. 30, 2000, May 30, 2001 and Aug. 30, 2001, respectively, all of which are hereby incorporated by reference.

BACKGROUND OF THE INVENTION

1. Field of the Invention

The present invention relates to a liquid crystal display device, and more particularly to a liquid crystal display device which is constituted of a liquid crystal display panel and a backlight which is arranged on a back surface of the liquid crystal display panel.

2. Description of the Related Art

The liquid crystal display device of this type allows a viewer to recognize images by observing light irradiated from a backlight through a liquid crystal therebetween display panel which controls a light transmission quantity for each pixel of the liquid crystal display panel.

Conventionally, there has been known a liquid crystal display panel which mounts a switching element which is driven with a supply of gate signals from a gate signal line and a pixel electrode to which video signals are supplied from a drain signal line through the switching element on each pixel region which is formed on a liquid-crystal-side surface of one of substrates which are arranged to face each other while sandwiching liquid crystal therebetween.

The pixel electrode generates an electric field between the pixel electrode and a counter electrode which is arranged close to the pixel electrode, for example, and the light transmittivity of the liquid crystal is controlled in response to this electric field.

On the other hand, as the backlight, for making the irradiation of light uniform along with the large-sizing of the liquid crystal display panel, there has been used a so-called direct backlight which is constituted of a plurality of linear light sources (for example, cold cathode ray tubes) which are arranged in a plane parallel to a plane which includes the liquid crystal display panel and a reflection plate which is arranged on a back surface of the light source and reflects light irradiated from the light source toward the liquid crystal display panel side.

Then, along with the display driving of the liquid crystal display panel, the lighting of the backlight is maintained without being extinguished.

SUMMARY OF THE INVENTION

However, with respect to the liquid crystal display device having such a constitution, it has been pointed out that although the display device can provide the clear display with respect to still picture images, the display device cannot provide the sufficiently clarity or discrimination with respect to motion picture images.

Recently, along with efforts to display television images on the liquid crystal display device, it is no more possible to ignore such a drawback.

That is, in the display of the motion picture images, the change of brightness of each pixel with respect to time is large and hence, the driving of the liquid crystal cannot follow such change of brightness. Accordingly, when a moving subject to be displayed moves from one position to another position, a retained image at one position is recognized so that the whole of the moving subject is displayed in a blurred state.

The invention has been made in view of the above circumstance and it is an object of the invention to provide a liquid crystal display device which can provide the clear images of motion picture in spite of an extremely simple constitution.

Further, it is another object of the invention to provide a liquid crystal display device which can display clear and bright images of motion picture without increasing the power consumption of a backlight.

To briefly explain the summary of typical inventions among inventions disclosed in the present application, they are as follows.

Means 1.

The liquid crystal display device according to the invention is, for example, directed to a liquid crystal display device having a backlight, wherein the backlight has a first state in which the backlight outputs a first amount of light and a second state in which the backlight outputs a second amount of light, and the time for the first state and the time for the second state are controlled.

Means 2.

The liquid crystal display device according to the invention is, for example, directed to a liquid crystal display device having a backlight, wherein the backlight has a first state in which a first voltage is applied to the backlight and a second state in which a second voltage is applied to the backlight, and the time for the first state and the time for the second state are controlled.

Means 3.

The liquid crystal display device according to the invention is, for example, directed to a liquid crystal display device having a liquid crystal display panel which includes a plurality of scanning lines and a backlight, wherein a first voltage and a second voltage are applied at a given frame and the given frame is in synchronism with a frame to control a plurality of above-mentioned scanning lines.

Means 4.

The liquid crystal display device according to the invention includes, for example, a liquid crystal display panel and a backlight which is arranged at a back surface of the liquid crystal display panel, wherein the backlight is repeatedly subjected to lighting and extinguishing and includes means for controlling a comparison of the lighting time and the extinguishing time.

Means 5.

The liquid crystal display device according to the invention includes, for example, a liquid crystal display panel which has switching elements which are driven with the supply of gate signals from gate signal lines and pixel electrodes to which drain signals are supplied from drain signal lines through the switching elements in each pixel region on a liquid-crystal-side surface of one of respective substrates which are arranged to face each other in an opposed manner through liquid crystal, and a backlight which is arranged on a back surface of the liquid crystal display panel, and the backlight includes means which repeats the lighting and extinguishing in synchronism with the starting of the supply of scanning signals and controls the ratio between the lighting time and the extinguishing time.

Means 6.

The liquid crystal display device according to the invention is, for example, on the premise of the constitution of the means 3, characterized in that the lighting and the extinguishing of the backlight is performed once for each frame between a synchronous signal for data rewriting and a next synchronous signal for data rewriting.

Means 7.

The liquid crystal display device according to the invention includes, for example, a liquid crystal display panel and a backlight which is arranged on a back surface of the liquid crystal display panel, wherein the liquid crystal display panel includes a liquid crystal display portion which is formed of a mass of a large number of pixels in the direction that liquid crystal interposed between a pair of substrates expands and respective pixels have pixel electrodes to which video signals are independently supplied, the liquid crystal display device includes detection means which detects the magnitude of the change of video signals to the pixel electrodes of respective pixel regions as the whole of the liquid crystal display portion, and backlight blinking means which makes the backlight repeat the lighting and the extinguishing when it is detected by the detecting means that the change of the video signals is large.

Means 8.

The liquid crystal display device according to the invention is, for example, on the premise of the constitution of the means 7, characterized in that the liquid crystal display device includes backlight blinking control means which, when the change of the video signals detected by the detecting means is large, decreases the duty of the lighting time in response to the degree of the magnitude of the change of the video signals.

Means 9.

The liquid crystal display device according to the invention is, for example, on the premise of the constitution of the means 8, characterized in that the backlight blinking control means includes means which increases an electric current supplied to the backlight when the duty of the lighting time is small.

Means 10.

The liquid crystal display device according to the invention includes, for example, a liquid crystal display panel and a backlight which is arranged on a back surface of the liquid crystal display panel, wherein the liquid crystal display panel includes a liquid crystal display portion which is formed of a mass of a large number of pixels in the direction that liquid crystal interposed between a pair of substrates expands and respective pixels have pixel electrodes to which video signals are independently supplied, the liquid crystal display device includes detection means which detects the magnitude of the change of video signals to the pixel electrodes of respective pixel regions as a region of a portion of the liquid crystal display portion, and backlight blinking means which makes the backlight repeat the lighting and the extinguishing when it is detected by the detecting means that the change of video signals is large.

Means 11.

The liquid crystal display device according to the invention is, for example, characterized in that respective regions which are surrounded by gate signal lines which are extended in the x direction and are arranged in parallel in the y direction and drain signal lines which are extended in the y direction and are arranged in parallel in the x direction on a liquid-crystal-side surface of one substrate of the liquid crystal display panel are defined as pixel regions and each pixel region is provided with a switching element which is driven by scanning signals from one-side gate signal line and a pixel electrode to which video signals are supplied from the drain signal line through the switching element, and the region of the portion of the liquid crystal display portion constitutes a region of a mass of respective pixel regions which are provided with pixel electrodes driven by some of the gate signal lines which are arranged close to each other.

Means 12.

The liquid crystal display device according to the invention is, for example, on the premise of the constitution of the means 11, characterized in that the region of the portion of the liquid crystal display portion constitutes a region of a mass of respective pixel regions which are provided with pixel electrodes driven by respective gate signal lines which run substantially at the center of the liquid crystal display portion.

Means 13.

The liquid crystal display device according to the invention is, for example, on the premise of the constitution of the means 11, characterized in that the region of the portion of the liquid crystal display portion constitutes a region of a mass of respective pixel regions which are provided with pixel electrodes driven by respective gate signal lines which run at least at one side except for substantially the center of the liquid crystal display portion.

Means 14.

The liquid crystal display device according to the invention is, for example, on the premise of the constitution of the means 10, characterized in that the liquid crystal display device includes backlight blinking control means which, when the change of the video signals detected by the detecting means is large, decreases the duty of the lighting time in response to the degree of the magnitude of the change of the video signals.

Means 15.

The liquid crystal display device according to the invention is, for example, on the premise of the constitution of the means 14, characterized in that the backlight blinking control means includes means which increases an electric current supplied to the backlight when the duty of the lighting time is small.

Means 16.

The liquid crystal display device according to the invention includes, for example, a liquid crystal display panel and a backlight which is arranged on a back surface of the liquid crystal display panel, wherein the liquid crystal display panel includes a liquid crystal display portion which is formed of a mass of a large number of pixels in the direction that liquid crystal interposed between a pair of substrates expands and respective pixels have pixel electrodes to which video signals are independently supplied, and a counter electrode which generates an electric field in response to the video signals between the pixel electrodes and the counter electrode, the liquid crystal display device includes detection means which detects the magnitude of video signals to the pixel electrodes of respective pixel regions as an average of the whole of the liquid crystal display portion when the video signals are large corresponding to the increase of the light transmittivity of the liquid crystal due to the electric field, and backlight blinking means which makes the backlight repeats the lighting and the extinguishing when it is detected by the detecting means that the video signals become large.

Means 17.

The liquid crystal display device according to the invention is, for example, on the premise of the constitution of the means 16, characterized in that the liquid crystal display device includes backlight blinking control means which, when the video signals detected by the detecting means are large, increases the duty of the lighting time in response to the degree of the magnitude of the video signals.

Means 18.

The liquid crystal display device according to the invention includes, for example, a liquid crystal display panel and a backlight which is arranged on a back surface of the liquid crystal display panel, wherein the backlight includes a plurality of linear light sources which are provided to a surface substantially parallel to a surface of the liquid crystal display panel, are extended in the x direction of the liquid crystal display panel and are arranged in parallel in the y direction, and among respective light sources, at the time of performing the display driving, the light source arranged at a center portion repeats the lighting and the extinguishing and other remaining light sources maintain the lighting.

Means 19.

The liquid crystal display device according to the invention is, for example, on the premise of the constitution of the means 18, characterized in that respective regions which are surrounded by gate signal lines which are extended in the x direction and are arranged in parallel in the y direction and drain signal lines which are extended in the y direction and are arranged in parallel in the x direction on a liquid-crystal-side surface of one of substrates which are arranged to face each other through liquid crystal are defined as pixel regions and each pixel region is provided with a switching element which is driven by scanning signals from one-side gate signal line and a pixel electrode to which video signals are supplied from the drain signal line through the switching element.

Means 20.

The liquid crystal display device according to the invention is, for example, on the premise of the constitution of the means 18, characterized in that to a portion which faces a plane determined by the respective light sources which repeat the lighting and the extinguishing out of a liquid crystal display portion formed of a mass of respective pixel regions of the liquid crystal display panel, backlight blinking control means which detects the change of the video signals to the pixel electrodes of the respective pixel regions and increases the duty of the lighting time in response to the degree of magnitude of the change is provided.

Means 21.

The liquid crystal display device according to the invention includes, for example, a liquid crystal display panel and a backlight which is arranged on a back surface of the liquid crystal display panel, wherein the backlight includes a plurality of linear light sources which are provided to a surface substantially parallel to a surface of the liquid crystal display panel, are extended in the x direction of the liquid crystal display panel and are arranged in parallel in the y direction, and at the time of performing the display driving, the respective light sources repeat the lighting and the extinguishing and the duty of the lighting of the light source arranged at a center portion is set smaller than the duty of the lighting of the remaining other light sources.

Means 22.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and the light source arranged at least at a center portion repeats the lighting and the extinguishing and the light source disposed at least at one of both sides of the center portion maintains the lighting.

Means 23.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and at the time of performing the sequential display of respective frames of the liquid crystal display panel, for each frame, the light source arranged at least at a center portion repeats the lighting and the extinguishing without changing a phase and the light sources disposed at least at one of both sides of the center portion repeats the lighting and the extinguishing while shifting the phase.

Means 24.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and each light source repeats the lighting and the extinguishing at the same frequency and the frequency of the lighting and extinguishing of the light source disposed at least at a center portion is set smaller than the frequency of the lighting and extinguishing of the light source disposed at least at one of both sides of the center portion.

Means 25.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and each light source repeats the lighting and the extinguishing and the duty of the lighting of the light source disposed at a center portion is set smaller than the duty of the lighting of the light sources disposed at least at one of both sides of the center portion.

Means 26.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and the light source disposed at least at a center portion repeats the lighting and the extinguishing and the light source disposed at least at one of both sides of the center portion maintains the lighting and also receives a less amount of a supply current or a supply voltage than a supply current or a supply voltage to the light source disposed at the center portion.

Means 27.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and the light sources disposed at a center portion repeat the lighting and the extinguishing and the light source disposed at least at one of both sides of the center portion maintains the lighting, and an arrangement pitch between the light sources disposed at one of both sides of the center portion is set larger than an arrangement pitch between the neighboring other light sources.

Means 28.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and the light source disposed at least at a center portion repeats the lighting and the extinguishing and the light source disposed at least at one of both sides of the center portion maintain the lighting, and at least one of the light source disposed at the center portion and the light source disposed at least at one of both sides of the light source disposed at the center portion is capable of controlling the magnitude of a supply current or a supply voltage.

Means 29.

The liquid crystal display device according to the invention includes, for example, a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and at least one of the light source disposed at a center portion and the light sources disposed at least at one of both sides of the light source disposed at the center portion is capable of controlling the duty of the lighting relative to the extinguishing.

Means 30.

The liquid crystal display device according to the invention is constituted such that, for example, the liquid crystal display device includes a liquid crystal display panel and a backlight, the backlight is capable of repeating the lighting and the extinguishing, the liquid crystal display device is capable of changing over a display mode between a motion picture display mode and a still picture display mode and performing the lighting and extinguishing of the backlight in the motion picture display mode, wherein the improvement being characterized in that the frequency of rewriting image at the time of the motion picture display mode is set higher than the frequency of rewriting image at the time of the still picture display mode.

Means 31.

The liquid crystal display device according to the invention is characterized, for example, on the premise of respective constitutions of means 1 to 30, that the liquid crystal display device includes a mode which enables the display of a motion picture and a still picture by changing over them and the lighting and the extinguishing of the backlight are repeated in the motion picture display mode.

Means 32.

The liquid crystal display device according to the invention includes, for example, a liquid crystal display panel having a plurality of scanning lines and a backlight, wherein the backlight is constituted to irradiate a plurality of amounts of light which differ along with the lapse of time within a frame in which a plurality of the above-mentioned scanning lines are controlled.

Means 33.

The liquid crystal display device according to the invention is, for example, on the premise of the constitution of the means 32, characterized in that a plurality of amounts of light consists of a first amount of light, a second amount of light and a third amount of light and the length of time of at least one of these amounts of light can be controlled.

Means 34.

The liquid crystal display device according to the invention includes, for example, a liquid crystal display panel having a plurality of scanning lines and a backlight which has a plurality of light sources arranged parallel to a virtual surface which is substantially parallel to the liquid crystal display panel, wherein The lighting and the extinguishing of a plurality of these light sources are repeated after the starting of supply of scanning signals and at least one light source is lit with a delay of at least one frame which controls the scanning signals.

Means 35.

The liquid crystal display device according to the invention is, for example, on the premise of the constitution of the means 34, characterized in that the lighting of the light source which is lit with the delay has the time integral value of the frame for controlling the scanning lines which is substantially equal to the time integral value of other frame for controlling the lighting of other light source or the scanning lines.

Means 36.

The liquid crystal display device according to the invention is, for example, on the premise of the constitution of the means 34, characterized in that the delay is set within a range from minus 8 ms to plus 8 ms from the starting point of supply of the scanning signals.

Means 37.

The liquid crystal display device according to the invention includes, for example, a liquid crystal display panel having a plurality of scanning lines and a backlight, wherein the backlight is configured to irradiate a plurality of amounts of light which differ along with the lapse of time to a liquid crystal display panel side within a frame in which a plurality of scanning lines are controlled, and in performing screen scanning in plural times, the scanning is performed such that the screen becomes a black display in one screen scanning.

Means 38.

The liquid crystal display device according to the invention includes, for example, a liquid crystal display panel having a plurality of scanning lines and a backlight having a plurality of light sources which are arranged in the extending direction of the scanning lines and are extended in the direction which intersects the scanning extending direction within a virtual plane which is parallel to the liquid crystal display panel, in performing screen scanning in plural times, the scanning is performed such that the screen becomes a black display in one screen scanning, and a frame in which an amount of light is changed is repeated with respect to at least one of respective light sources within the frame of scanning.

Means 39.

The liquid crystal display device according to the invention includes, for example, a liquid crystal display panel having a plurality of scanning lines and a backlight having a plurality of light sources which are arranged in the extending direction of the scanning lines and are extended in the direction which intersects the scanning extending direction within a virtual plane which is parallel to the liquid crystal display panel, in performing screen scanning in plural times, the scanning is performed such that the screen becomes a black display in one screen scanning, and a frame in which an amount of light is changed is repeated with respect to respective light sources within the frame of scanning and an amount of light of at least one of the light sources is minimized.

Means 40.

The liquid crystal display device according to the invention is, for example, on the premise of the constitution of the means 38, characterized in that the delay of the change starting period of an amount of light is generated with respect to the light sources in the frame of the screen scanning.

Means 41.

The liquid crystal display device according to the invention is, for example, on the premise of the constitution of the means 3, characterized in that the change starting period of an amount of light is set substantially equal with respect to the light sources in the frame of the screen scanning.

PREFERRED EMBODIMENTS OF THE PRESENT INVENTION

Preferred embodiments of a liquid crystal display device according to a present invention are explained in conjunction with attached drawings hereinafter.

Embodiment 1

[Equivalent Circuit of Liquid Crystal Display Device]

Figure 2:
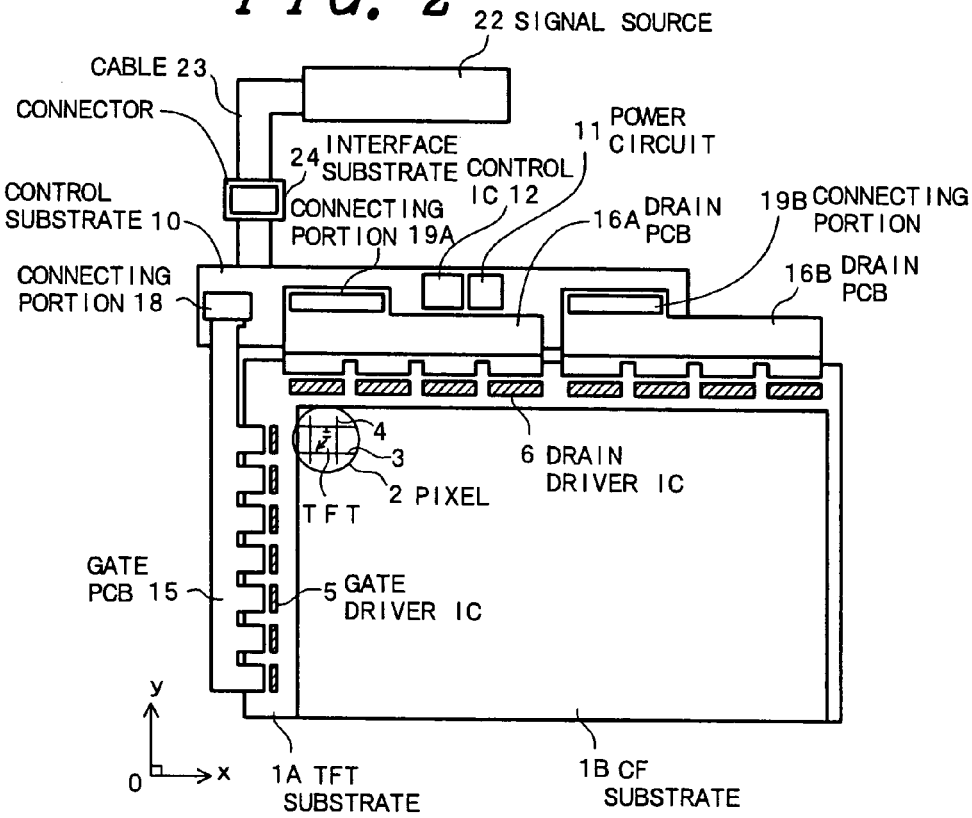
FIG. 2 is a plan view showing one embodiment of a liquid crystal panel of the liquid crystal display device according to the invention.

FIG. 2 is an equivalent circuit diagram showing one embodiment of a liquid crystal display device according to the invention. Although the drawing is a circuit diagram, it is drawn corresponding to an actual geometric arrangement.

In this embodiment, the present invention is applied to a liquid crystal display device which adopts a so-called lateral electric field type which is known as a type having a wide viewing angle.

First of all, a liquid crystal display panel 1 is shown in FIG. 2 and this liquid crystal display panel 1 uses transparent substrates 1A, 1B which are arranged to face each other while sandwiching liquid crystal therebetween thus constituting an envelope. In this case, one transparent substrate (a lower-side substrate in the drawing, a matrix substrate 1A) is formed slightly larger than the other transparent substrate (an upper-side substrate in the drawing, a color filter substrate 1B), while in the drawing, these transparent substrates are arranged such that their lower-side and right-side peripheral ends are substantially aligned on the same plane.

As a result, the left-side periphery and the upper-side periphery in the drawing of one transparent substrate 1A are extended outwardly relative to the other transparent substrate 1B. As will be explained in detail later, this portion constitutes a region on which gate drivers 5 and drain drivers 6 are mounted.

In a region where respective transparent substrates 1A, 1B are superposed, pixels 2 which are arranged in a matrix array are disposed. Each pixel 2 is formed in a region which is surrounded by scanning signal lines 3 which are extended in the x direction and are arranged in parallel in the y direction in the drawing and video signal lines 4 which are extended in the y direction and are arranged in parallel in the x direction in the drawing. Each pixel 2 includes at least a switching element TFT which is driven with the supply of scanning signals from one scanning signal line 3 and a pixel electrode to which video signals supplied from one video signal line 4 is applied through the switching element TFT.

Here, as mentioned previously, each pixel 2 adopts a so-called lateral electric field type and hence, as will be explained in detail later, each pixel 2 includes a counter electrode and an additional capacitance element besides the above-mentioned switching element TFT and pixel electrode.

Here, one end (a left-side end portion in the drawing) of each scanning signal line 3 is extended to the outside of the transparent substrate 1B and is arranged to be connected with an output terminal of the gate driver (IC) 5 mounted on the transparent substrate 1A.

In this case, a plurality of gate drivers 5 are formed and, at the same time, each scanning signal line 3 is formed into a group together with neighboring scanning signal lines 3 and the grouped scanning signal lines 3 are respectively connected to respective gate drivers 5 which are disposed close to the scanning signal lines 3.

Further, in the same manner, one end (upper-side end portion in the drawing) of each video signal line 4 is extended to the outside of the transparent substrate 1B and is connected to an output terminal of the drain driver (IC) 6 mounted on the transparent substrate 1A.

Also in this case, a plurality of drain drivers 6 are formed and, at the same time, each video signal line 4 is formed into a group together with neighboring video signal lines 4 and the grouped video signal lines 4 are respectively connected to respective drain drivers 6 which are disposed close to the video signal lines 4.

On the other hand, a printed circuit board 10 (control substrate 10) is arranged close to the liquid crystal display panel 1 on which these gate drivers 5 and drain drivers 6 are mounted. On this printed circuit board 10, in addition to a power circuit 11 and the like, a control circuit 12 which is served for supplying input signals to the gate drivers 5 and the drain drivers 6 is mounted.

Here, signals transmitted from the control circuit 12 are supplied to the gate drivers 5 and the drain drivers 6 through flexible wiring circuit boards (a gate circuit board 15, a drain circuit board 16A, a drain circuit board 16B).

That is, at the gate driver 5 side, the flexible wiring circuit board (the gate circuit board 15) which is provided with terminals connected with input-side terminals of respective gate drivers 5 in an opposed manner is arranged.

The gate circuit board 15 has a portion thereof extended to the control substrate 10 side and the gate circuit board 15 and the control substrate 10 are connected to each other through a connecting portion 18 at the extended portion of the gate circuit board 15.

Output signals transmitted from the control circuit 12 mounted on the control substrate 10 are inputted to respective gate drivers 5 through a wiring layer on the control substrate 10, the connecting portion 18 and the wiring layer on the gate circuit board 15.

Further, at the drain driver 6 side, drain circuit boards 16A, 16B which are provided with terminals respectively connected to input-side terminals of respective drain driver 6 in an opposed manner are arranged.

The drain circuit boards 16A, 16B have portions thereof extended to the control substrate 10 side and the drain circuit boards 16A, 16B and the control substrate 10 are connected to each other through connecting portions 19A, 19B.

Output signals transmitted from the control circuit 12 mounted on the control substrate 10 are inputted to respective drain drivers 6 through a wiring layer on the control substrate 10, the connecting portions 19A, 19B and the wiring layer on the drain circuit boards 16A, 16B.

The drain circuit boards 16A, 16B at the drain driver 6 side are divided into two pieces as shown in the drawing. This provision is made to prevent to defects caused by thermal expansion brought about by the increase of the length of the drain circuit board in the x direction in the drawing, for example, along with the enlargement of the size of the liquid crystal display panel 1 or the like.

Then, outputs from the control circuit 12 on the control substrate 10 are inputted to the corresponding drain driver 6 through the connecting portion 19A of the drain circuit board 16A and the connecting portion 19B of the drain circuit board 16B.

Further, video signals are supplied to the control substrate 10 from a video signal source 22 through a cable 23 and an interface board 24 and these video signals are inputted to the control circuit 12 mounted on the control substrate 10.

Although the liquid crystal display panel 1, the gate circuit board 15, the drain circuit boards 16A, 16B and the control substrate 10 are illustrated in the drawing such that they are positioned substantially within the same plane, in reality, the control substrate 10 is bent at portions of the gate circuit board 15 and the drain circuit boards 16A, 16B and is positioned substantially perpendicular to the liquid crystal display panel 1.

This provision is provided for decreasing the area of a so-called picture frame. Here, "picture frame" means a region defined by a profile of an outer frame and a profile of a display portion of the liquid crystal display device.

By decreasing this area, an advantageous effect that the area of the display portion can be increased with respect to the outer frame can be obtained.

[Module of Liquid Crystal Display Device]

Figure 3:
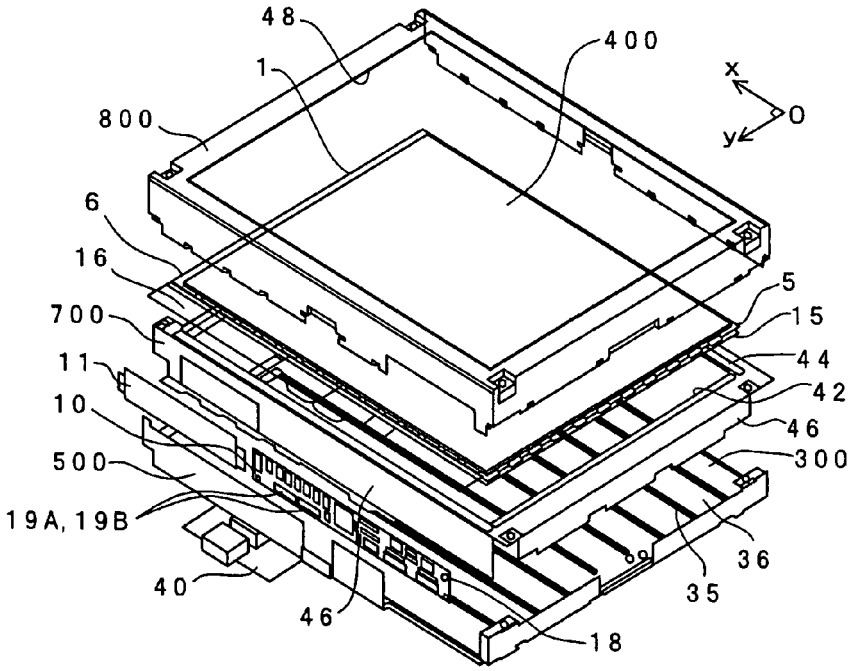
FIG. 3 is an exploded perspective view showing one embodiment of the liquid crystal display device according to the invention.

FIG. 3 is an exploded perspective view showing one embodiment of a module of the liquid crystal display device according to the invention.

The liquid crystal display device shown in the drawing is substantially comprised of a liquid crystal display panel module 400, a backlight 300, a resin frame body 500, an intermediate frame 700, an upper frame 800 and the like and these elements are formed into a module.

In this embodiment, a reflection plate which constitutes a portion of the backlight 300 is formed on a bottom surface of the resin frame body 500. Although it is difficult to physically distinguish the resin frame body 500 and the backlight 300, they can be classified in the above-mentioned manner in view of their functions.

These respective members are sequentially explained hereinafter.

[Liquid Crystal Display Panel Module]

The liquid crystal display panel module 400 is constituted of a liquid crystal display panel 1, the gate drivers IC 5 and drain drivers IC 6 which are formed of a plurality of semiconductor ICs mounted on a periphery of the liquid crystal display panel 1 and the flexible gate circuit board 15 and drain circuit boards 16 (16A, 16B) which are connected to input terminals of respective driving ICs.

That is, outputs from the control substrate 10 which will be explained later in detail are inputted to the gate drivers IC5 and the drain drivers IC6 on the liquid crystal display panel 100 through the gate circuit board 15 and the drain circuit boards 16A, 16B and outputs of these respective driver ICs are inputted to the scanning signal lines 2 and the video signal lines 3 of the liquid crystal display panel 1.

Figure 4:
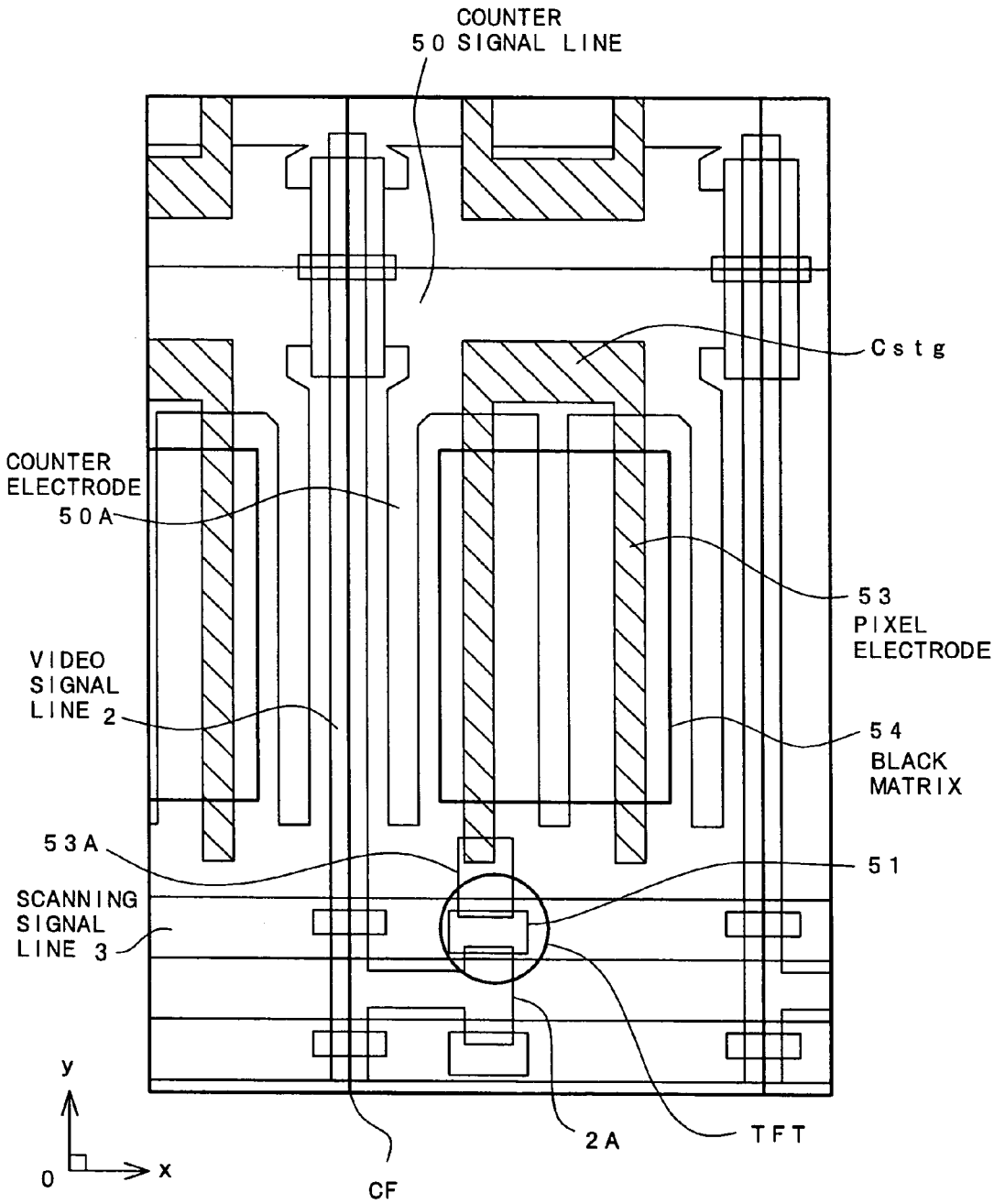
FIG. 4 is a plan view showing one embodiment of a pixel of the liquid crystal display device according to the invention.

Here, as mentioned above, with respect to the liquid crystal display panel 1, a display region portion thereof is constituted of a large number of pixels arranged in a matrix array and the constitution of such a pixel is shown in FIG. 4.

In the drawing, on a main surface of the matrix substrate 1A, the scanning signal lines 3 and a counter voltage signal line 50 which are extended in the x direction are formed. Then, a region which is surrounded by these respective signal lines 3, 50 and the video signal lines 2 which will be explained later and are extended in the y direction is defined as a pixel region.

That is, in this embodiment, the signal lines are arranged such that the counter voltage signal line 50 runs between the scanning signal lines 3 and the pixel regions are formed in the ± y direction using the counter voltage signal line 50 as a boundary.

Due to such a constitution, the number of the counter voltage signal lines 50 which are arranged in parallel in the y direction can be decreased by halves compared to conventional counter voltage signal lines. Accordingly, the region closed by the counter voltage signal line 50 can be shared by the pixel region side so that the area of the pixel region can be increased.

In each pixel region, for example, three counter electrodes 50A which are integrally formed with the counter voltage signal line 50 and are extended in the y direction are formed in an equi-spaced manner. These respective counter electrodes 50A are extended such that they are arranged close to each other without being connected to the scanning signal lines 3. Among these counter electrodes 50A, two side counter electrodes 50A are arranged close to the video signal lines 3 and the remaining one counter electrode 50A is positioned at the center.

Further, on the main surface of the transparent substrate 1A on which the scanning signal line 3, the counter voltage signal line 50 and the counter electrodes 50A are formed, an insulation film made of a silicon nitride film, for example, which covers these scanning signal line 3 and the like is formed. As will be explained later, this insulation film functions as an interlayer insulation film which enables an insulation against the scanning signal line 3 and the counter voltage signal line 50 with respect to the video signal line 2. Further, this insulation film functions as a gate insulation film with respect to a thin film transistor TFT. Still further, the insulation film functions as a dielectric film with respect to a storage capacitance Cstg.

On a surface of this insulation film, first of all, a semiconductor layer 51 is formed on a region where a thin film transistor TFT is formed. This semi-conductor layer 51 is made of amorphous Si, for example, and is formed on a portion close to the video signal line 2 which is disposed over the scanning signal line 3 in a superposed manner as will be explained later. Due to such a constitution, a portion of the scanning signal line 3 also functions as a gate electrode of the thin film transistor TFT. Then, on the surface of the insulation film, the video signal lines 2 which are extended in the y direction and are arranged in parallel in the x direction are formed. These video signal lines 2 are integrally provided with the drain electrode 2A which is formed such that the drain electrode 2A is extended to a portion of the surface of the semi-conductor layer 51 which constitutes the thin film transistor TFT.

Further, on the surface of the insulation film in the pixel region, a pixel electrode 53 which is connected to a source electrode 53A of the thin film transistor TFT is formed. This pixel electrode 53 is formed by extending the respective centers of the counter electrodes 50A in the y direction. That is, one end of the pixel electrode 53 also functions as the source electrode 53A of the thin film transistor TFT. One end of the pixel electrode 53 is further extended in the y direction and is extended over the counter voltage signal line 50 in the x direction and thereafter is extended in the y direction thus forming a U shape.

Here, a portion of the pixel electrode 53 which is superposed on the counter voltage signal line 50 constitutes a storage capacitance Cstg between the pixel electrode 53 and the counter voltage signal line 50, wherein the storage capacitance Cstg uses the insulation film as a dielectric film. Due to this storage capacitance Cstg, it becomes possible to obtain an advantageous effect that when the thin film transistor TFT is turned off, for example, video information can be stored in the pixel electrode 53 for a long time.

A surface of the semiconductor layer 51 which corresponds to an interface between the drain electrode 2A and the source electrode 53A of the above-mentioned thin film transistor TFT is doped with phosphorous (P) thus forming a high concentration layer whereby an ohmic contact is brought about between these electrodes. Here, the high concentration layer is formed on the entire area of the surface of the semiconductor layer 51. Accordingly, the above-mentioned constitution can be obtained by forming respective electrodes and thereafter etching the high concentration layer other than the electrode forming region using these electrodes as masks.

On the upper surface of the insulation film on which the thin film transistor TFT, the video signal lines 2, the pixel electrodes 53 and the storage capacitance Cstg are formed in the above-mentioned manner, a protective film which is made of a silicon nitride film, for example, is formed. On an upper surface of this protective film, an orientation film is formed thus constituting a so-called lower-side substrate of the liquid crystal display panel 1.

Although not shown in the drawing, on a liquid-crystal-side portion of the transparent substrate (color filter substrate) 1B which constitutes a so-called upper-side substrate, a black matrix (corresponding to numeral 54 in FIG. 4) which has opening portions at portions thereof corresponding to respective pixel regions is formed.

Further, color filters are formed such that the color filters cover the opening portions formed at portions corresponding to the pixel regions of the black matrix 54. Each color filter has color different from color of the color filter at the neighboring pixel region in the x direction and these color filters have boundary portions on the black matrix 54.

Further, a flat film which is formed of a resin film or the like is formed on a surface on which the black matrix and the color filters are formed and an orientation film is formed on a surface of the flat film.

[Backlight]

On a back surface of the liquid crystal display panel module 400, the backlight 300 is arranged.

Figure 5:
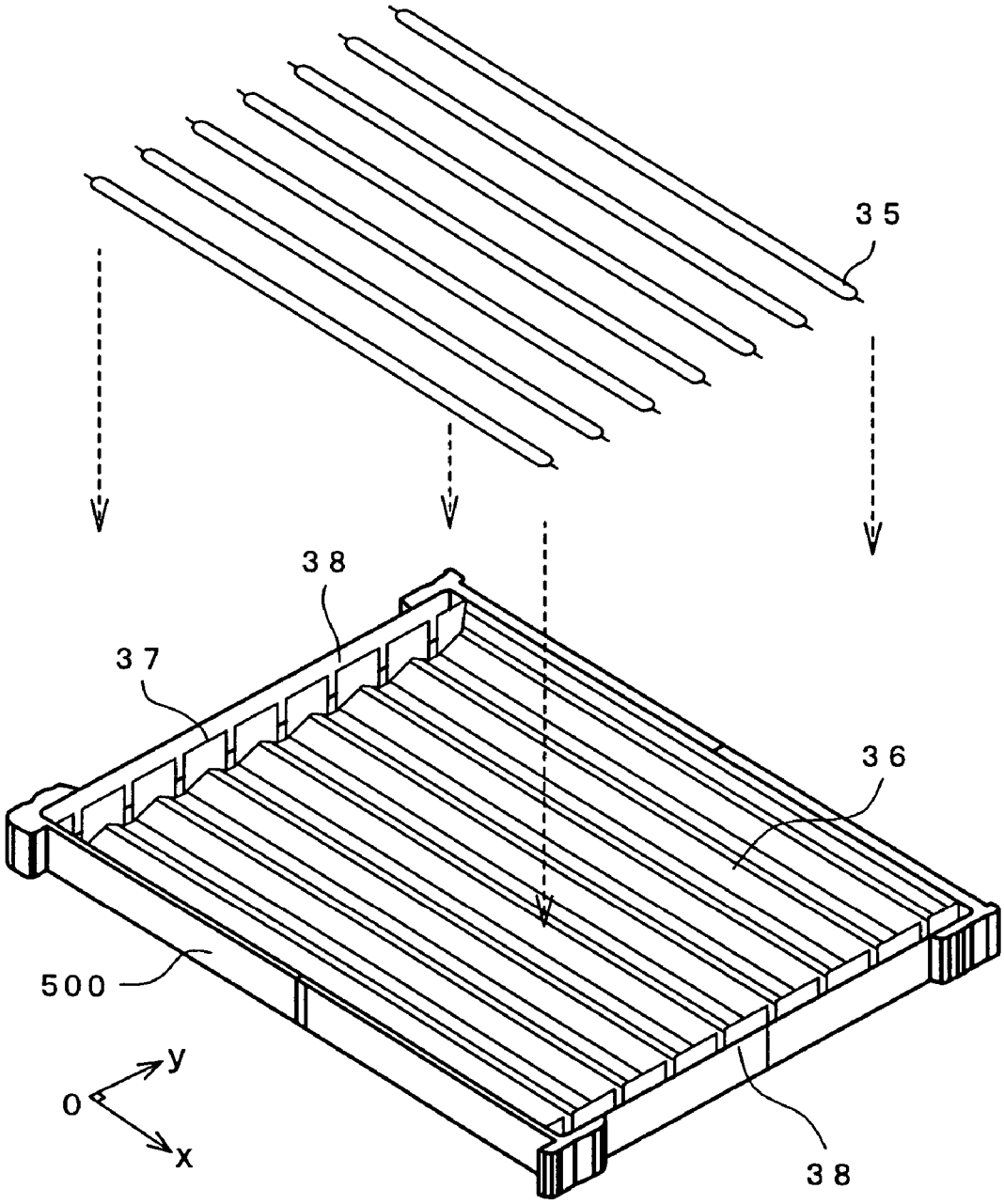
FIG. 5 is a perspective view showing one embodiment of a backlight of the liquid crystal display device according to the invention.

This backlight 300 is a so-called direct type backlight and the detail of this backlight is shown in FIG. 5. In the drawing, the backlight 300 is constituted of a plurality (8 pieces in the drawing) of equidistantly arranged linear light sources 35 which are extended in the x direction and are arranged in parallel in the y direction in the drawing and a reflection plate 36 which is served for irradiating light from the light source 35 toward the liquid crystal display panel module 400.

The reflection plate 36 is formed in a wave form in the direction parallel to the light source 35 (y direction), for example. That is, the reflection plate 36 has arcuate recessed portions at positions where respective light sources 35 are arranged, protrusions which are more or less sharpened are formed between respective light sources 35 thus providing a shape which is efficient for irradiating the whole light from respective light sources 35 toward the liquid crystal display panel module side.

Here, the reflection plate 36 is provided with side surfaces 37 along sides which are perpendicular to the longitudinal direction of respective light sources 35 and both end portions of respective light sources 35 are fitted into slits 38 formed in the side surfaces 37 thus restricting the movement of the light sources 35 in the parallelly-arranged direction.

As the light sources 35, so-called cold cathode ray lamps are used, for example, and these lamps can be lit by applying a voltage to electrodes formed on both ends thereof.

Further, it is needless to say that hot cathode ray fluorescent lamps, xenon lamps, vacuum fluorescent display tubes or the like can be used as the light sources 35.

[Resin Frame]

The resin frame 500 constitutes a portion of an outer frame of the liquid crystal display device which is formed into a module and accommodates the backlight 300 therein.

Here, the resin frame 500 has a box shape which includes a bottom wall and side walls. Upper end surfaces of the side walls are formed such that a diffusion plate (not shown in the drawing) which is arranged to cover the backlight 300 can be mounted on the upper end surfaces.

The diffusion plate has a function of diffusing light from respective light sources 35 of the backlight 300. With the provision of this diffusion plate, the uniform light which is free from the unevenness of brightness can be irradiated toward the liquid crystal display panel module 400 side.

Here, the resin frame 500 is formed with a relatively thin wall thickness. This is because that the decrease of mechanical strength brought about by such a constitution can be compensated by the reinforcement brought about by an intermediate frame 700 which will be explained hereinafter.

[Intermediate Frame]

As shown in FIG. 3, the intermediate frame 700 is arranged between the liquid crystal display panel module 400 and the diffusion plate (not shown in the drawing).

The intermediate frame 700 is constituted of a metal plate having a relatively thin wall thickness and an opening 42 is formed in the intermediate frame 700 at a portion thereof corresponding to a display region portion of the liquid crystal display panel module 400.

The intermediate frame 700 has a function of pressing the diffusion plate to the resin frame 500 and a function of mounting the liquid crystal display panel module 400 thereon.

To provide such functions, a spacer 44 for positioning the liquid crystal display panel 1 is mounted on a portion of an upper surface of the intermediate frame 700 on which the liquid crystal display panel module 400 is mounted. Due to such a constitution, the liquid crystal display panel 1 can be accurately positioned with respect to the intermediate frame 700.

The intermediate frame 700 is configured such that side walls 46 are integrally formed. That is, the intermediate frame 700 is configured such that the opening 42 is formed on a bottom wall of the metal plate having an approximately box shape.

The intermediate frame 700 having such a configuration can be fitted into the resin frame 500 in the state that the diffusion plate is arranged between the intermediate frame 700 and the resin frame 500. That is, with respect to the resin frame 500, the intermediate frame 700 is mounted such that inner surfaces of the side walls 46 face outer surfaces of the side walls of the resin frame 500.

The intermediate frame 700 which has the above-mentioned constitution and is made of the metal plate constitutes one frame (housing) together with the resin frame 500 so that the mechanical strength thereof can be enhanced without increasing the wall thickness of the resin frame 500.

That is, even when the intermediate frame 700 and the resin frame 500 do not have the sufficient mechanical strength respectively, due to the above-mentioned fitting engagement or arrangement, the mechanical strength can be enhanced. Particularly, the strength against the twisting around the diagonal lines of the box can be enhanced.

[Upper Frame]

The upper frame 800 has a function of pressing the liquid crystal display panel module 400, the intermediate frame 700 and the diffusion plate toward the resin frame 500 and constitutes the outer frame of the module of the liquid crystal display device together with the resin frame 500.

The upper frame 800 is formed of a metal plate having an approximately box-like shape and an opening (display window) 48 is formed in the metal plate at a portion corresponding to the display region portion of the liquid crystal display panel module 400. The upper frame 800 is mounted on the resin frame 500 by an engagement, for example.

<<Image Movement Degree Detection Circuit>>

Figure 6:
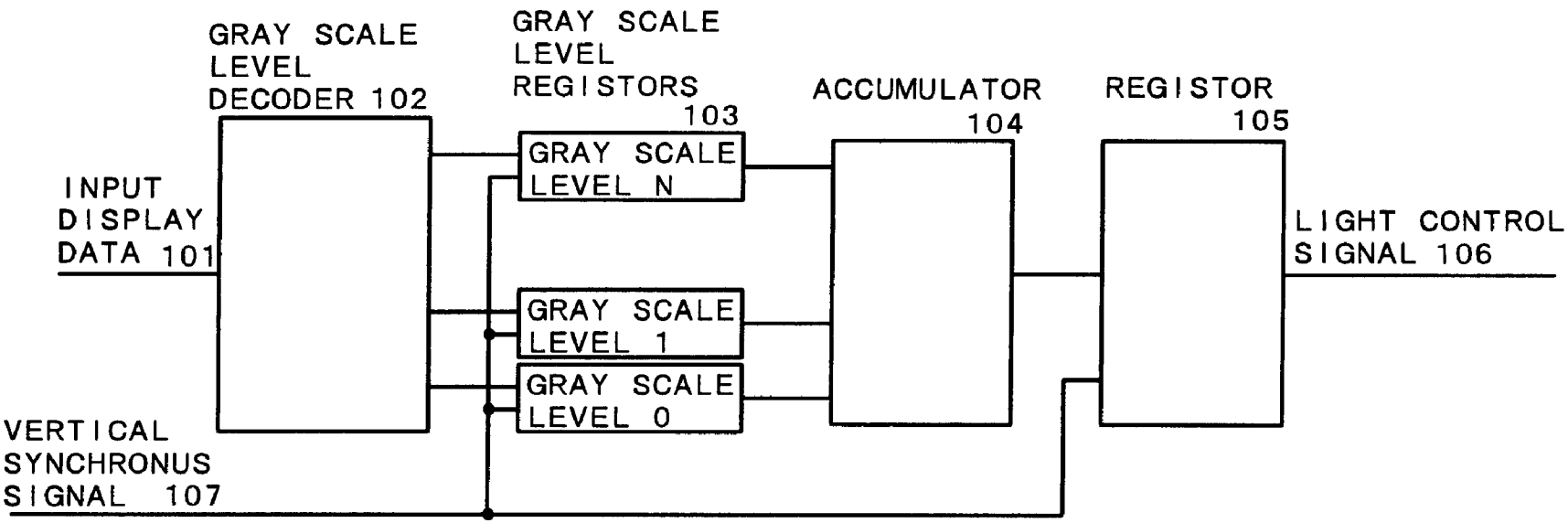
FIG. 6 is a block diagram showing one embodiment of a circuit which detects whether a motion picture image is displayed or a still picture image is displayed in the liquid crystal display device according to the invention.

FIG. 6 is a circuit diagram which shows one embodiment of a circuit for detecting the degree of movement of images displayed on the liquid crystal display panel 1 (referred to as "image movement degree detection circuit" in this specification). The image movement degree detection circuit is mounted on the control substrate 10 shown in FIG. 2 or the like, for example.

In the drawing, first of all, the image movement degree detection circuit includes a gray scale level decoder 102 and input display data 101 is inputted to this gray scale level decoder 102.

Here, the input data 101 is outputted from a frame memory not shown in the drawing.

The input display data 101 is composed of a large number of pixel data having respective gray scales from 0 to N. Respective pixel data are classified for each gray scale at the gray scale level decoder 102 and when the pixel data which corresponds to the gray scale is found at each gray scale, for example, a signal "1" is outputted and when the pixel data is not found, for example, a signal "0" is outputted.

That is, the gray scale level decoder 102 is provided with (N+1) pieces of output terminals and outputs a signal which indicates the presence or absence of 0 gray scale pixel data, a signal which indicates the presence or absence of 1 gray scale pixel data, a signal which indicates the presence or absence of 2 gray scale pixel data, . . . or a signal which indicates the presence or absence of N gray scale pixel data of the input display data 101 from the output terminal corresponding to the signal.

Here, even when a plurality of N gray scale pixel data are present in the input display data 101, for example, the gray scale level decoder 102 outputs the signal "1", from the corresponding output terminal irrespective of the number of the N gray scale pixel data.

Respective outputs from the gray scale level decoder 102 are respectively inputted to a group of gray scale level registers 103 consisting of a 0 gray scale level register, a 1 gray scale level register, . . . and an N gray scale level register.

That is, the signal which is outputted from the gray scale level decoder 102 and indicates the presence or absence of the 0 gray scale pixel data is inputted to the 0 gray scale level register, the signal which indicates the presence or absence of the 1 gray scale pixel data is inputted to the 1 gray scale level register, . . . and the signal which indicates the presence or absence of the N gray scale pixel data is inputted to the N gray scale level register.

Due to such a constitution, either one of the signal "1", or the signal "0" is stored in respective gray scale level registers of the group of gray scale level registers 103.

Further, respective outputs from respective gray scale level registers are inputted to an accumulator 104.

The accumulator 104 adds respective outputs from respective gray scale level registers and outputs a signal which corresponds to an added value.

For example, when the signals "1" are respectively inputted from all of the 0 gray scale level register, the 1 gray scale level register, . . . and the N gray scale level register, the signal which corresponds to the added value (N+1) of respective signals is outputted. Alternatively, when the signals "1" are outputted from the 4 gray scale level register and the 6 gray scale level register and the signals "0" are outputted from other remaining gray scale level registers, the signal which corresponds to the added value (2) of respective signals is inputted.

It is apparent from the above description that the accumulator 104 detects the degree of change of gray scale in the input display data 101.

That is, the accumulator 104 detects the degree of change of the gray scale of the input display data 101 and can determine whether the input display data 101 indicates a still picture image or a motion picture image in response to the magnitude of the degree of change.

Further, when the input display data 101 indicates the motion picture image, the accumulator 104 can determine even the magnitude of the movement based on the output of the accumulator 104.

Subsequently, the output of the accumulator 104 is inputted and held in a register 105 and thereafter is outputted as a backlight control signal 106.

Here, a vertical synchronous signal 107 is inputted to respective registers which constitute a group of gray scale level registers 103 and the register 105 such that respective gray scale level registers 103 and the register 105 are reset by the vertical synchronous signal 107.

Due to such a constitution, the control signal to the backlight from the register 105 is generated for each input display data corresponding to one screen.

<<Backlight Control Circuit>>

Figure 7:
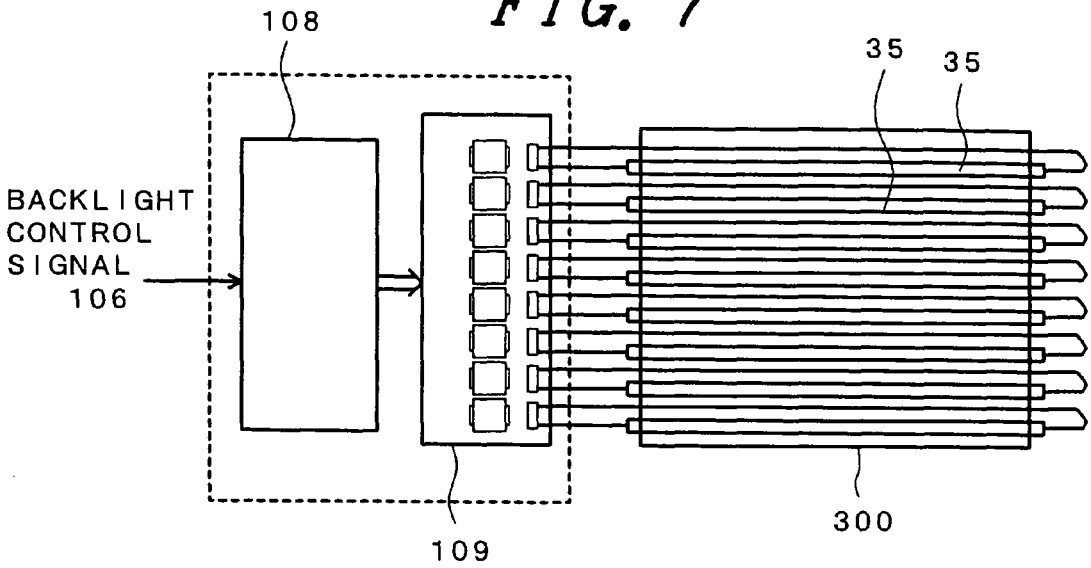
FIG. 7 is a block diagram showing one embodiment of a circuit which controls the lighting condition of a backlight depending on whether a motion picture image is displayed or a still picture image is displayed in the liquid crystal display device according to the invention.
Figure 8A:
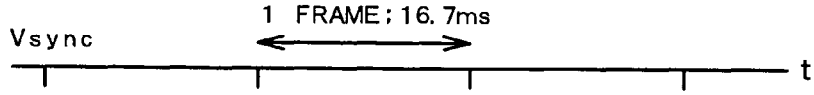
FIG. 8 is an explanatory view showing the brightness waveform of the backlight in response to a control signal for the backlight.
Figure 8B:
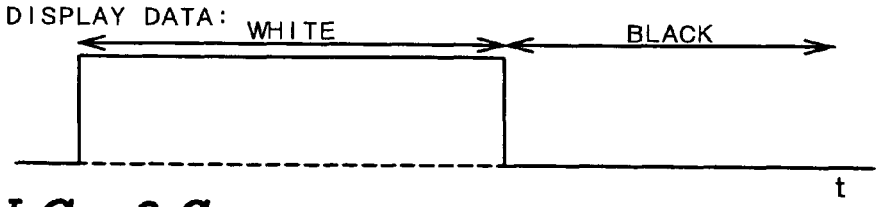
Figure 8C:
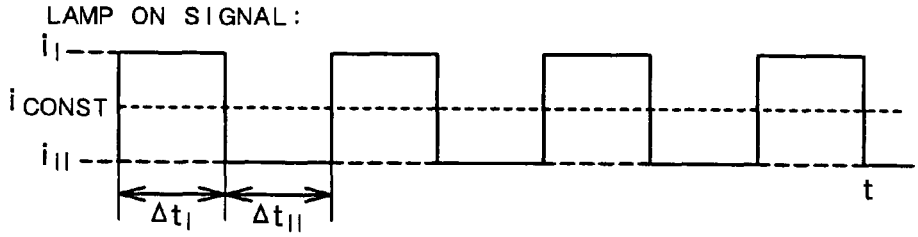
Figure 8D:
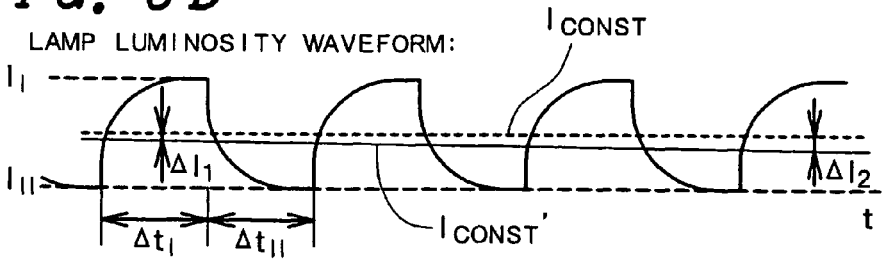
Figure 9A:
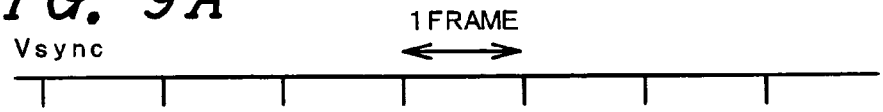
FIG. 9 is a timing chart showing another embodiment of the blinking of the backlight of the liquid crystal display device according to the invention.
Figure 9B:
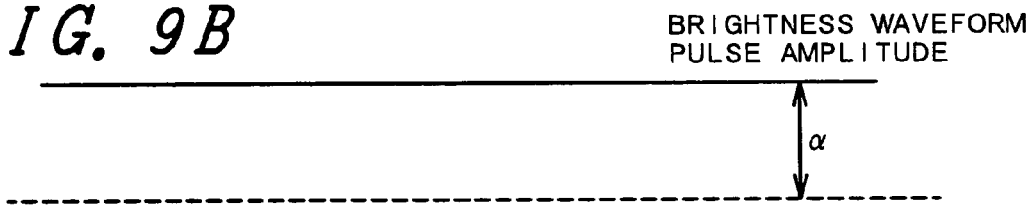
Figure 9C:
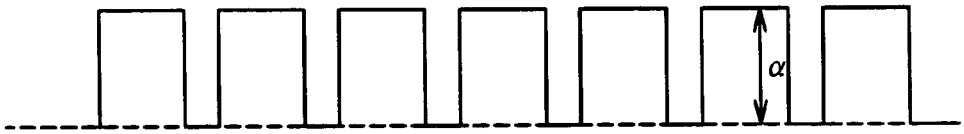
Figure 9D:
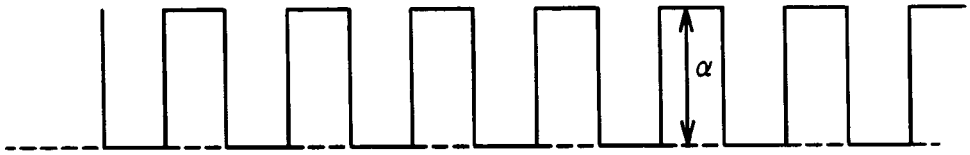
Figure 9E:
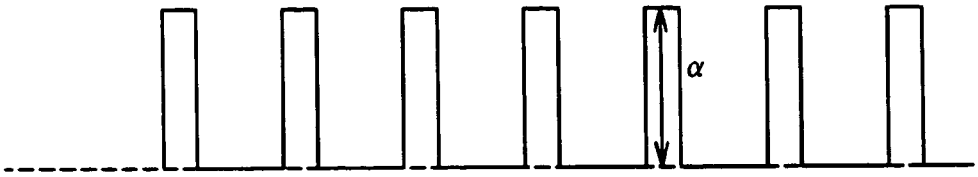

FIG. 7 shows a backlight control circuit (a portion surrounded by a dotted line in the drawing) to which the output from the image movement degree detection circuit is inputted and which controls the driving of respective light sources 35 of the backlight 300 in response to the output.

In the drawing, the backlight control circuit includes a signal information classifying circuit 108 to which the output from the image movement degree detection circuit, that is, the backlight control signal 106 is inputted.

This signal information classifying circuit 108 classifies the signal information into (1) a still picture image, (2) a motion picture image with the slow movement, (3) a motion picture image with the normal movement, and (4) a motion picture image with the fast movement in response to the information of the backlight control signal 106 and outputs a signal corresponding to the classification to an inverter 109.

The inverter 109 includes a circuit which converts a DC voltages to an AC voltage, a current control circuit, a frequency modulation circuit, a boosting circuit formed of a transformer and the like.

Figure 1A:
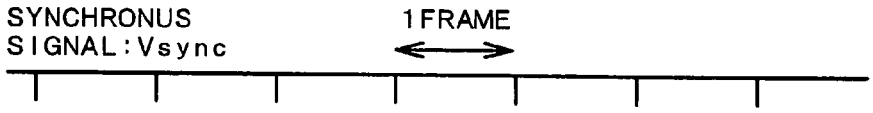
FIG. 1 is a timing chart showing one example of blinking of a backlight of a liquid crystal display device according to the invention.
Figure 1B:
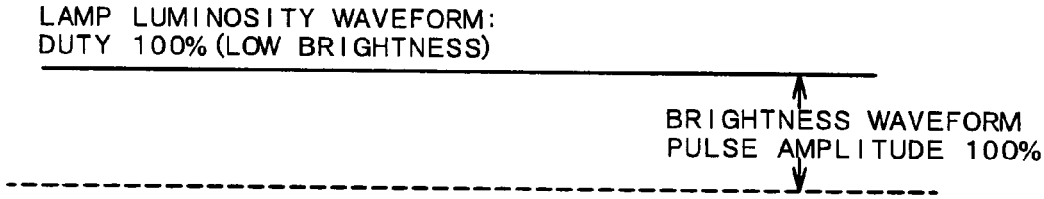

When the signal corresponding to the classification to the still picture image is inputted to the inverter 109, the inverter 109 is, as shown in FIG. 1B, controlled to make respective light sources of the backlight 300 maintain the lighting state.

Figure 1C:
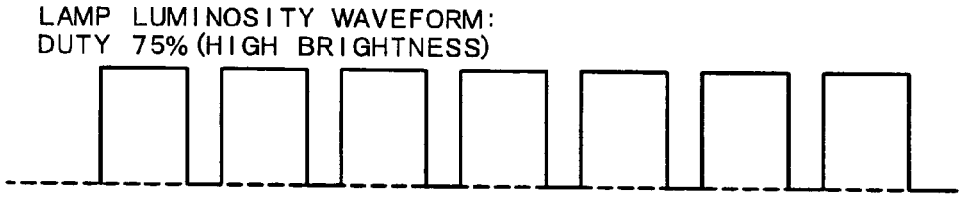

Then, when the signal corresponding to the motion picture image with the slow movement is inputted to the inverter 109, the inverter 109 is, as shown in FIG. 1C, controlled to make respective light sources of the backlight 300 repeat the lighting state and the extinguishing state.

Figure 1D:
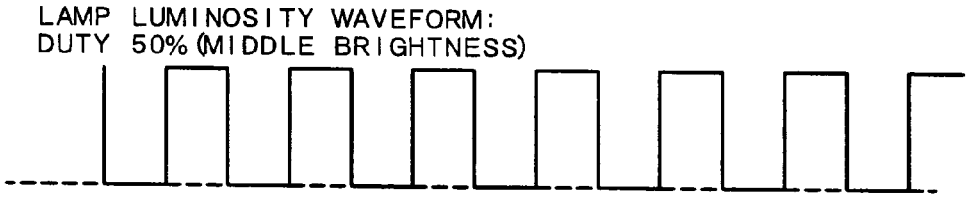

Further, when the signal corresponding to the motion picture image with the normal movement is inputted to the inverter 109, the inverter 109 is, as shown in FIG. 1D, also controlled to make respective light sources of the backlight 300 repeat the lighting state and the extinguishing state. However, in this case, the inverter 109 is controlled such that the lighting state time is set shorter than the former case.

Figure 1E:
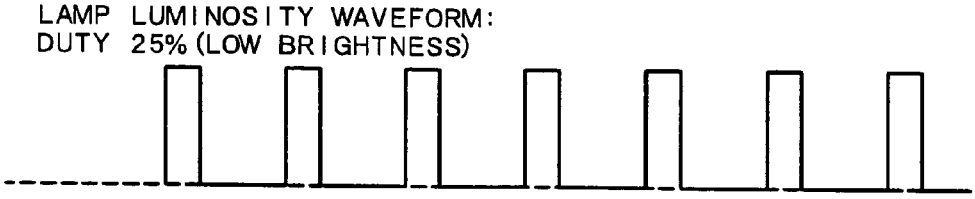

Still further, when the signal corresponding to the motion picture image with the fast movement is inputted to the inverter 109, the inverter 109 is, as shown in FIG. 1E, also controlled to make respective light sources of the backlight 300 repeat the lighting state and the extinguishing state. However, in this case, the inverter 109 is controlled such that the lighting state time is set further shorter than the former case.

In FIG. 1, (a) indicates a synchronous signal (data rewriting frame, 16.7 ms in this embodiment). In case of the motion picture image, the backlight 300 is configured to perform one lighting and one extinguishing within a frame between the synchronous signal and a next synchronous signal. That is, the lighting and the extinguishing of the backlight 300 are repeated in synchronism with the inputting start time of the gate signal.

Further, the faster the movement of the motion picture image, that is, corresponding to the shifting of the mode from the mode (2) to the mode (4), the duty of the lighting is set to become smaller with respect to the relationship between the lighting and the extinguishing of the backlight 300.

Due to such a constitution, the discrimination of the motion picture can be enhanced and, at the same time, the degree of discrimination can be held at the same level irrespective of the speed of the movement of the motion picture.

Here, when the motion picture image is displayed (see modes (2) to (4)), the lighting and the extinguishing of the backlight are repeated and hence, the power consumption can be suppressed.

FIG. 8A to FIG. 8D respectively indicate a synchronous signal (a transmission timing of image information), display data, a lamp ON signal to the backlight 300 and a lamp luminosity waveform irradiated from the backlight 300.

The lighting signal to the backlight 300 is served for supplying a first current (a lamp current) $I_1$ to the backlight 300 for a time $\Delta t_1$ (a first period) and subsequently supplying a second current (a lamp current) $I_2$ (=0 mA) which is smaller than the first current $I_1$ to the backlight 300 for a time $\Delta t_2$ (a second period).

The lighting signal supplied to the backlight 300 is in synchronism with the synchronous signal and the time ($\Delta t_1 + \Delta t_2$) is set equal to a frame (16.7 ms in this embodiment) of respective synchronous signals.

Here, the relationship $\Delta t_1 = \Delta t_2$ is established with respect to the lighting signal, the lamp current flows into the backlight 300 at the duty of 50%.

Then, in supplying the current $I_1$ (6 mA) to the light source for the first period $\Delta t_1$ shown in FIG. 8, (1) the brightness at the duty of 100% (an extinguishing period $\Delta t_2 = 0$) is set to 100% and the motion picture discrimination is set to 2 in the 5-stage evaluation.

(2) at the duty of 75%, the brightness is lowered to approximately 80%. However, the motion picture discrimination is increased to 3 since the light irradiated from the backlight 300 becomes similar to the impulse emitted light.

(3) at the duty of 50%, the brightness is lowered to approximately 60%. However, the motion picture discrimination is increased to 4.

Figure 11:
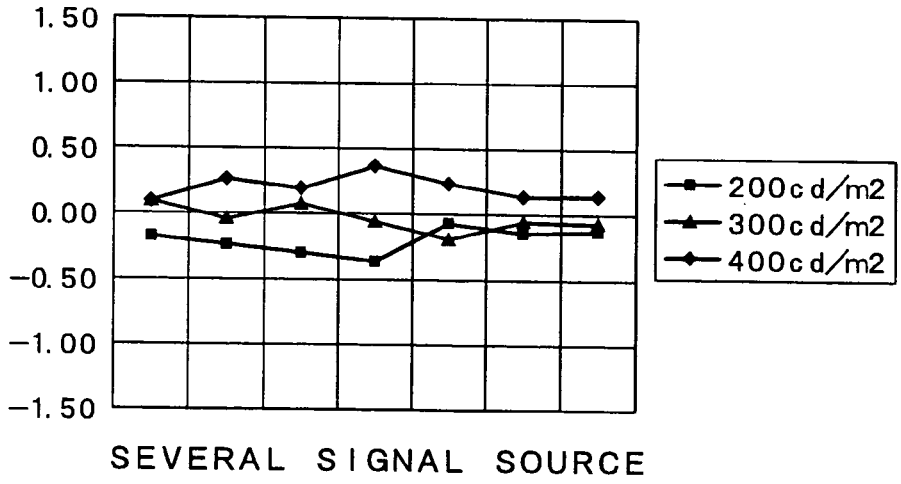
FIG. 11 is a view for explaining an advantageous effect of the liquid crystal display device of the invention.

From the above constitution, as shown in FIG. 9 which is a drawing corresponding to FIG. 11 by sequentially increasing the lamp current (a brightness waveform pulse amplitude $\alpha$) which is supplied to respective light sources of the backlight corresponding to the decrease of the duty, the lowering of the brightness on the whole of the display surface can be prevented and the motion picture image discrimination can be enhanced.

Further, when the effective value of the lamp current supplied to respective light sources of the backlight 300 is fixed irrespective of the duty change, the brightness of the whole of the display surface can be fixed.

Figure 10:
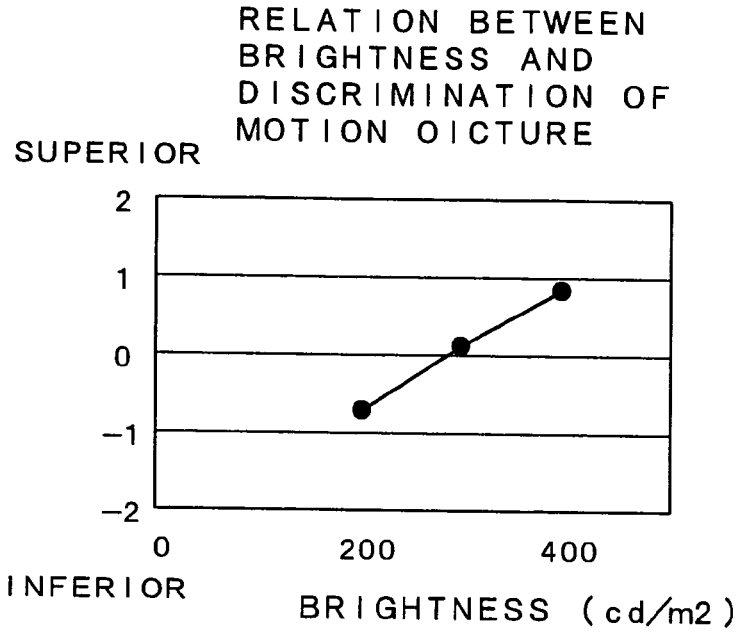
FIG. 10 is a view for explaining an advantageous effect of the liquid crystal display device of the invention.

FIG. 10 is a graph showing the result of a subject test which indicates the relationship between the brightness and the discrimination of the motion picture on the display surface.

As can be clearly understood from the graph, a phenomenon that discrimination of the motion picture can be increased corresponding to the increase of the brightness is observed.

This implies that, as mentioned above, the repetition of the lighting and extinguishing of the backlight 300 and the increase of the lamp current (the increase of the brightness)

respectively constitute factors which enhance the discrimination of the motion picture image and by increasing the lamp current when the duty is decreased, coupled effects can be obtained.

Further, FIG. 11 is a graph showing that when the brightness is enhanced in any one of the above-mentioned modes (2) to (4)(a pixel source), the discrimination of the motion picture is enhanced.

Embodiment 2

The above-mentioned embodiment is characterized by repeating the lighting and the extinguishing of the light sources of the backlight 300 when the image has the movement.

However, it is needless to say that whether the screen of the display portion is bright or dark is first detected and then the lighting and the extinguishing of the light sources of the backlight 300 may be repeated when the screen is dark.

It is because that when a scene is displayed on the display portion at night, for example, the screen generally becomes dark so that the recognition of a profile of a subject which moves within the screen becomes difficult. Even in such a case, by repeating the lighting and the extinguishing of the light sources of the backlight 300, the discrimination of the subject can be enhanced.

In this case, it may be possible to repeat the lighting and the extinguishing of the backlight 300 without increasing the lamp current. It is because that although the screen becomes slightly dark, the discrimination of the subject moving within the screen can be enhanced. In such a case, an advantageous effect that the power consumption can be reduced is obtained.

The means for detecting whether the screen of the display portion is bright or dark can be easily constituted such that, for example, the gray scales of respective pixel information (in this case, the respective pixel information may be respective pixel information which are extended over the entire region of the frame memory or respective selected pixel information which are arranged in a scattered manner) stored in the frame memory are detected and the mean value of the gray scales is calculated.

Here, in this case, it is needless to say that the gray scale is classified into a plurality of gray scales corresponding to the degree of darkness and the duty ratio of the lighting and the extinguishing can be changed corresponding to the classification. It is also needless to say that when the duty of the lighting is decreased, the magnitude of an amount of lamp current supplied to the backlight 300 is increased correspondingly.

Embodiment 3

Figure 12:
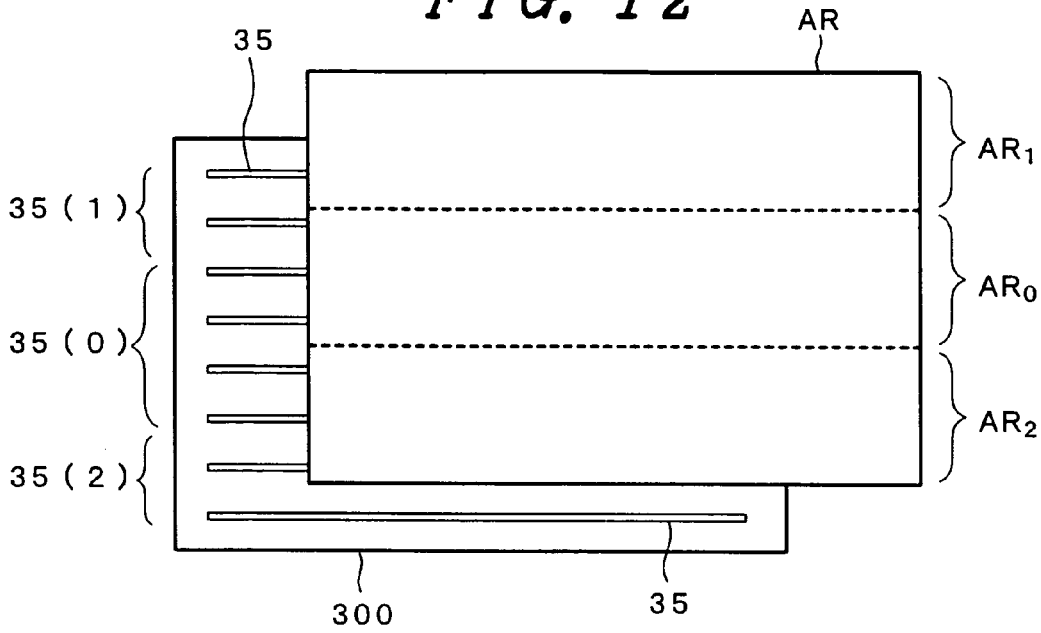
FIG. 12 is an explanatory view showing another embodiment of the liquid crystal display device according to the invention.

FIG. 12 is an explanatory view showing another embodiment of a liquid crystal display device according to the present invention.

In the drawing, a display surface AR of a liquid crystal display panel 1 is conceptually classified into three regions consisting of a center region $AR_0$ and respective regions $AR_1$, $AR_2$ which are disposed above and below the center region $AR_0$, wherein respective light sources 35 (0) of a backlight 300 which are in charge of the transmission of light at the center region $AR_0$ are made to repeat the lighting and the extinguishing, while the respective light sources 35 (1), 35 (2) of the backlight 300 which are in charge of the light transmission of light at the upper and lower regions $AR_1$, $AR_2$ are made to maintain the lighting.

The center of the display surface AR constitutes a region where the interest of an observer concentrates and a subject having the movement is usually displayed as an image on this region. This is apparent from an experimental rule of a photographing side that a photographer takes a picture by placing a portion where the concern of the observer concentrates at the center of the display screen.

Accordingly, in view of the fact that there exists a high possibility that the portion of the motion picture which has the movement is substantially inevitably positioned at the center of the display screen, the repetition of the lighting and the extinguishing of respective light sources of the backlight 300 which pass through the center of the display screen is set in advance.

In this case, the repeating duty of the lighting and the extinguishing of respective light sources may be fixed.

However, it is needless to say that the movement of the image of the portion is detected at the center of the display screen AR and the repeating duty of the lighting and the extinguishing of the light sources may be changed in response to the movement of the image.

In this case, by outputting input display data from a portion of the frame memory corresponding to the center of the display screen, the technique shown in FIG. 6 and FIG. 7 can be directly applied.

Further, in this embodiment, it is needless to say that, at respective upper and lower regions $AR_1$, $AR_2$ excluding the center of the display screen, it is not always necessary to make respective light sources of the backlight 300 which pass through the regions maintain the lighting (always in the lighting state) and the lighting and the extinguishing are repeated (by making the lamp extinguishing period thereof shorter than that of the center region $AR_0$).

In short, in view of the high provability that the motion picture having the fast movement is displayed as an image at the center of the display screen, it is enough for this embodiment if the lighting states of respective light sources of the backlight 300 which pass through the center portion and other portions are set to the optimum states respectively.

Further, as mentioned previously, when the duty of the lighting of the light sources is made small, the uniformity of the brightness over the entire display screen can be maintained by increasing the lamp current.

Further, there exists a display mode in which at a lower portion or an upper portion of the display screen on which the image is displayed, a character string moves using the image as a background. In such a case, the light sources which perform the transmission of light at the region corresponding to the lower portion or the upper portion of the display screen are made to repeat the lighting and the extinguishing.

Due to such a constitution, the discrimination of respective characters of the moving character string can be enhanced.

Embodiment 4

In any one of the above-mentioned respective embodiments, the explanation has been made with respect to the so-called direct type liquid crystal display device having the backlight 300.

Figure 13A:
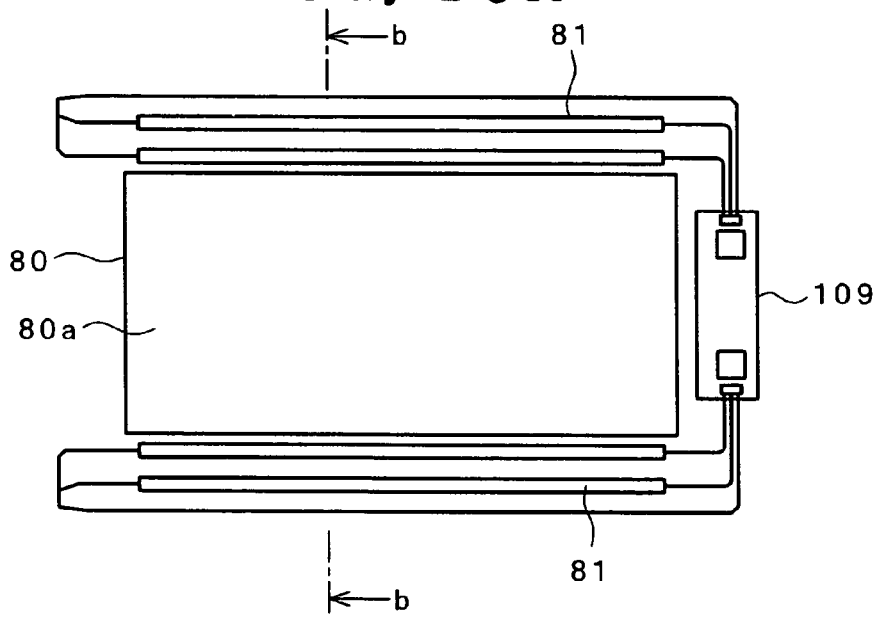
FIG. 13 is an explanatory view showing another embodiment of the liquid crystal display device according to the invention.
Figure 13B:
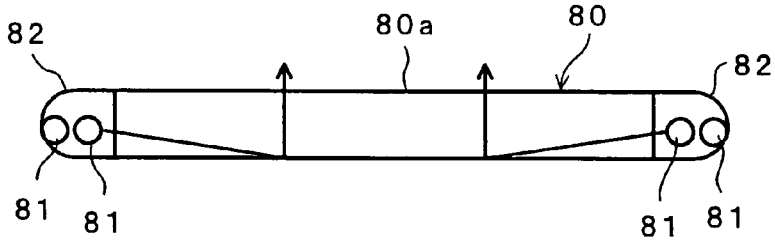

However, it is needless to say that the invention is applicable to a so-called side type liquid crystal display device having a backlight which adopts a light guide plate as shown in FIG. 13. Here, FIG. 13A is a plan view and FIG. 13B is a cross-sectional view taken along a line b-b of FIG. 13A.

As shown in the drawing, the liquid crystal display device is provided with a light guide plate at a back surface of a liquid crystal display panel not shown in the drawing, wherein the light guide plate is arranged substantially parallel to the liquid crystal display panel. Linear light sources 81 are arranged at side surfaces (upper and lower side surfaces in the drawing) of the light guide such that two light sources 81 are arranged at each side surface.

Light irradiated from the light sources directly or indirectly (through a reflection plate 82) enters the inside of the light guide plate 80 through the side surface of the light guide plate 80 and are reflected several times in the inside of the light guide plate 80 and thereafter is irradiated toward the liquid crystal display panel side from an opposing surface 80*a* of the liquid crystal display panel.

Such a backlight can not specify the light source which is in charge of the irradiation with respect to respective regions which are obtained by conceptually dividing the display portion of the liquid crystal display panel so that it is impossible to perform the lighting and the extinguishing of the light source at the region which constitutes a portion of the display portion.

However, by detecting whether the displayed image is the still picture image or the motion picture image as described in the embodiment 1 or by detecting whether the screen is the bright screen or the dark screen as described in the embodiment 2, it becomes possible to maintain the respective light sources of the backlight in the lighting state over the whole area of the display screen or to repeat the lighting and the extinguishing over the whole area of the display screen.

Further, in the same manner, it may be possible to reduce the duty of the repetition of the lighting and the extinguishing of the light sources of the backlight in response to the speed of the motion picture image or in response to the degree of the dark screen.

Embodiment 5

In the above-mentioned respective embodiments, when the liquid crystal display device is driven such that the lighting and the extinguishing are repeated with respect to all light sources 35, for example, there arises no specific problem with respect to the central portion on the screen of the liquid crystal display panel 1. However, a phenomenon that a profile of an image displayed at both upper and lower side portions appears in duplicate is recognized.

Figure 14:
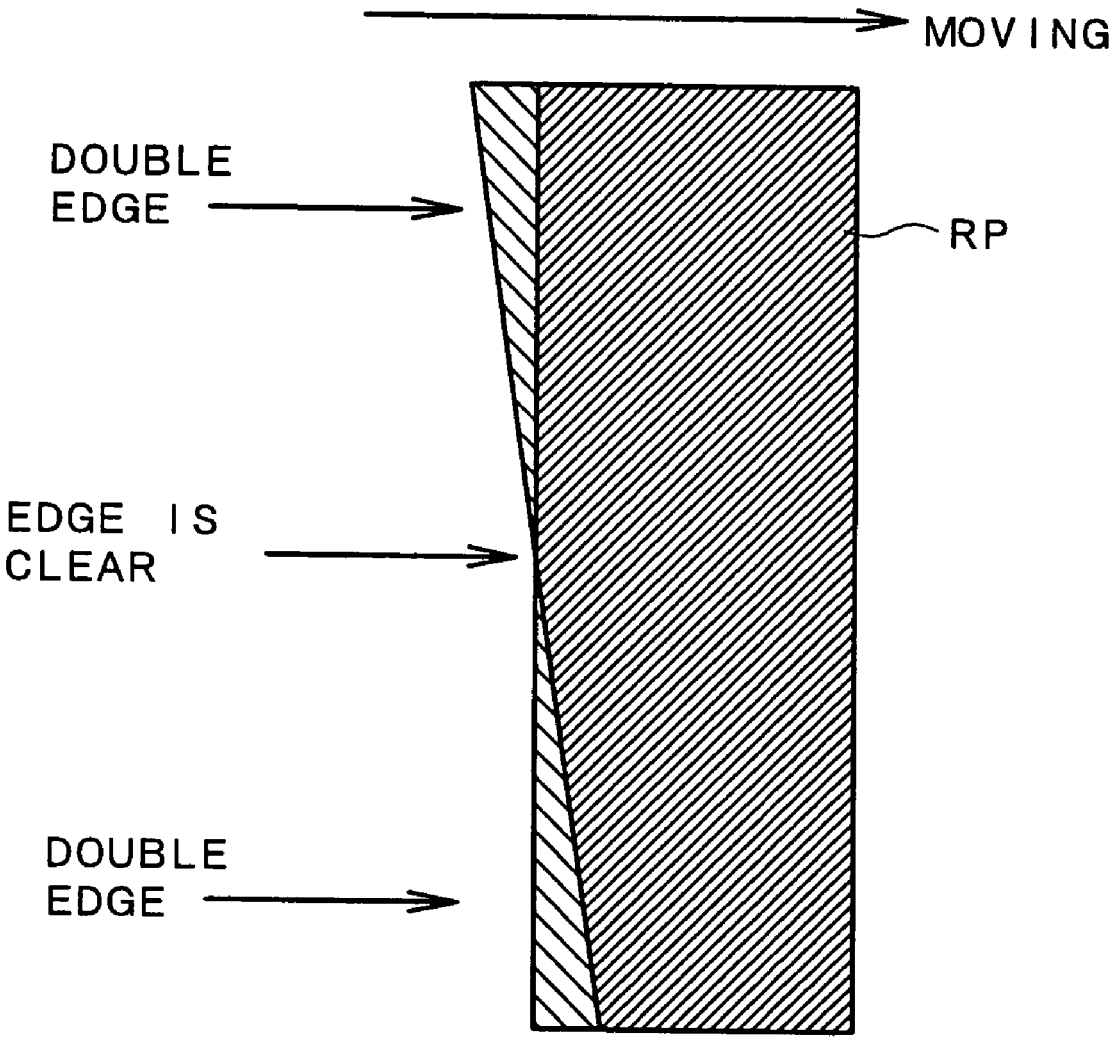
FIG. 14 is an explanatory view showing another embodiment of the liquid crystal display device according to the invention.

For example, as shown in FIG. 14, when a rod-like pattern RP which is extended vertically covering the full vertical length of a screen is displayed as an image by moving the pattern from the left to the right, although a left end side (edge) of the rod-like pattern RP is clearly observed at the center of the screen, a left end side of the rod-like pattern RP rises earlier at the upper end of the screen than at the center of the screen so that a thin shadow is observed and the left end side of the rod-like pattern RP responds with a delay at the lower end of the screen compared at the center of the screen so that a thin shadow is also observed.

The reason is explained in conjunction with FIG. 15. First of all, assume that data of one screen (one frame) is rewritten, for example, every 60 Hz (16.7 ms), there exists a delay of 16.7 ms from the starting of supply of a scanning signal (gate ON signal) to a gate signal line GL at an uppermost state (first stage) to the starting of supply of a scanning signal (gate ON signal) to a gate signal line GL at a lowermost state (nth stage).

This delay depends on the screen rewriting frame and the delay time becomes shorter when the frame becomes 120 Hz or 240 Hz. Further, although a rewriting signal is the gate signal in the liquid crystal display device which uses thin film transistors TFTs, the rewriting signal becomes the scanning signal or a common signal in a liquid crystal display device which uses so-called TFDs or the time-division driving.

This implies that the response of liquid crystal corresponding to respective pixels also gives rise to a delay from an upper side to a lower side of the screen.

Figure 15A:
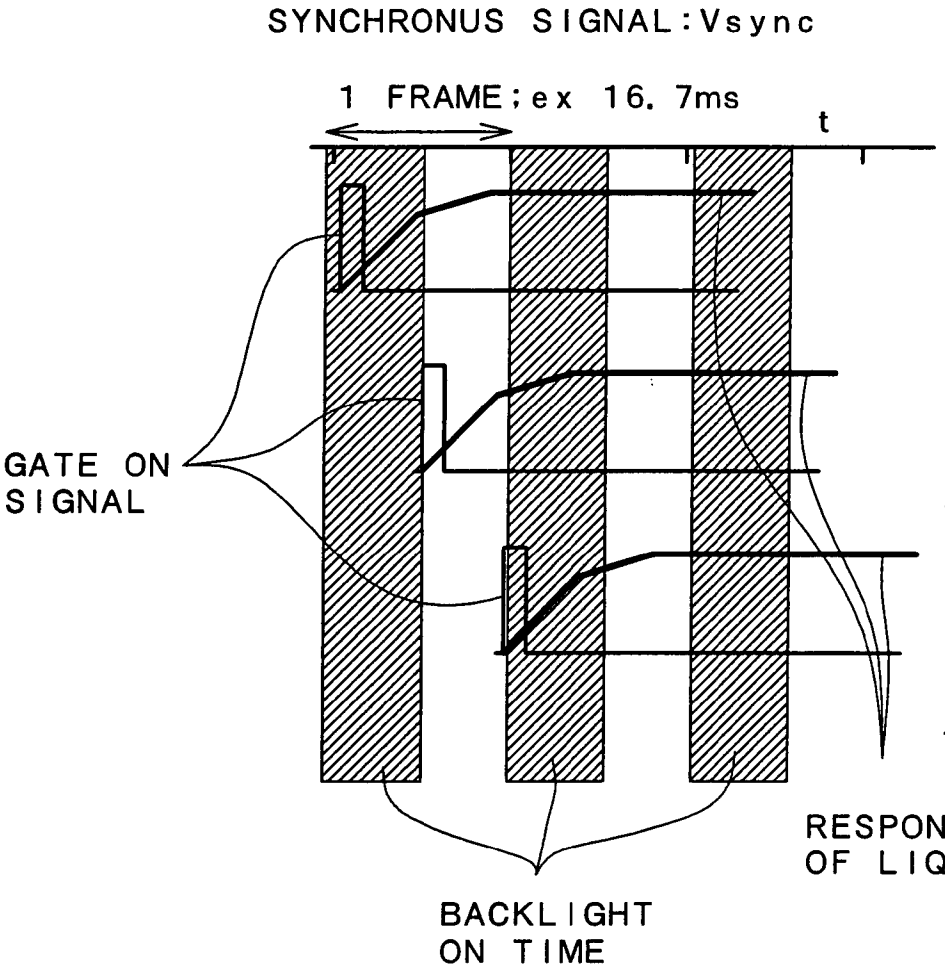
FIG. 15 is an explanatory view for explaining a reason for forming the constitution shown in FIG. 14.

However, when the lighting and the extinguishing of respective light sources 35 of the backlight are repeated at the same timing, the relationship between the lighting and the extinguishing of the light sources 35 and the responding waveform of the liquid crystal becomes as shown in FIG. 15A.

Figure 15B:
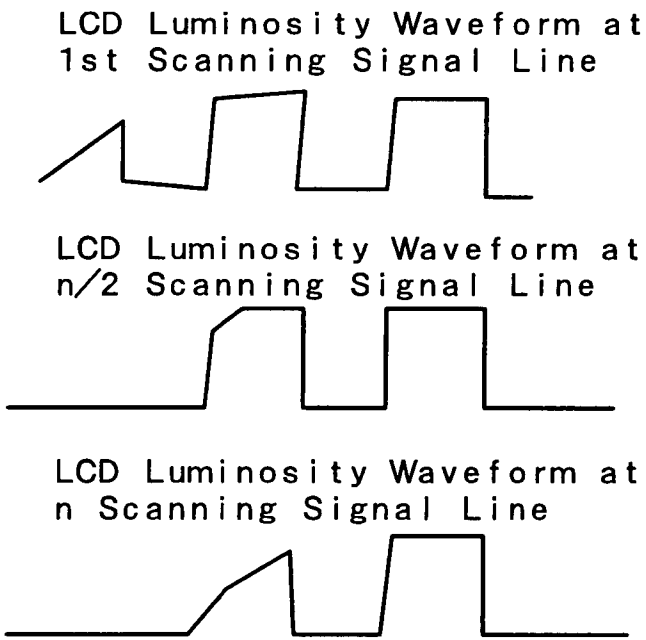

That is, the responding waveform of the liquid crystal in the lighting period of the light source 35 becomes as shown in FIG. 15B and the waveform shown in FIG. 15B directly becomes the brightness waveform which an observer of the liquid crystal display device can recognize.

Figure 16:
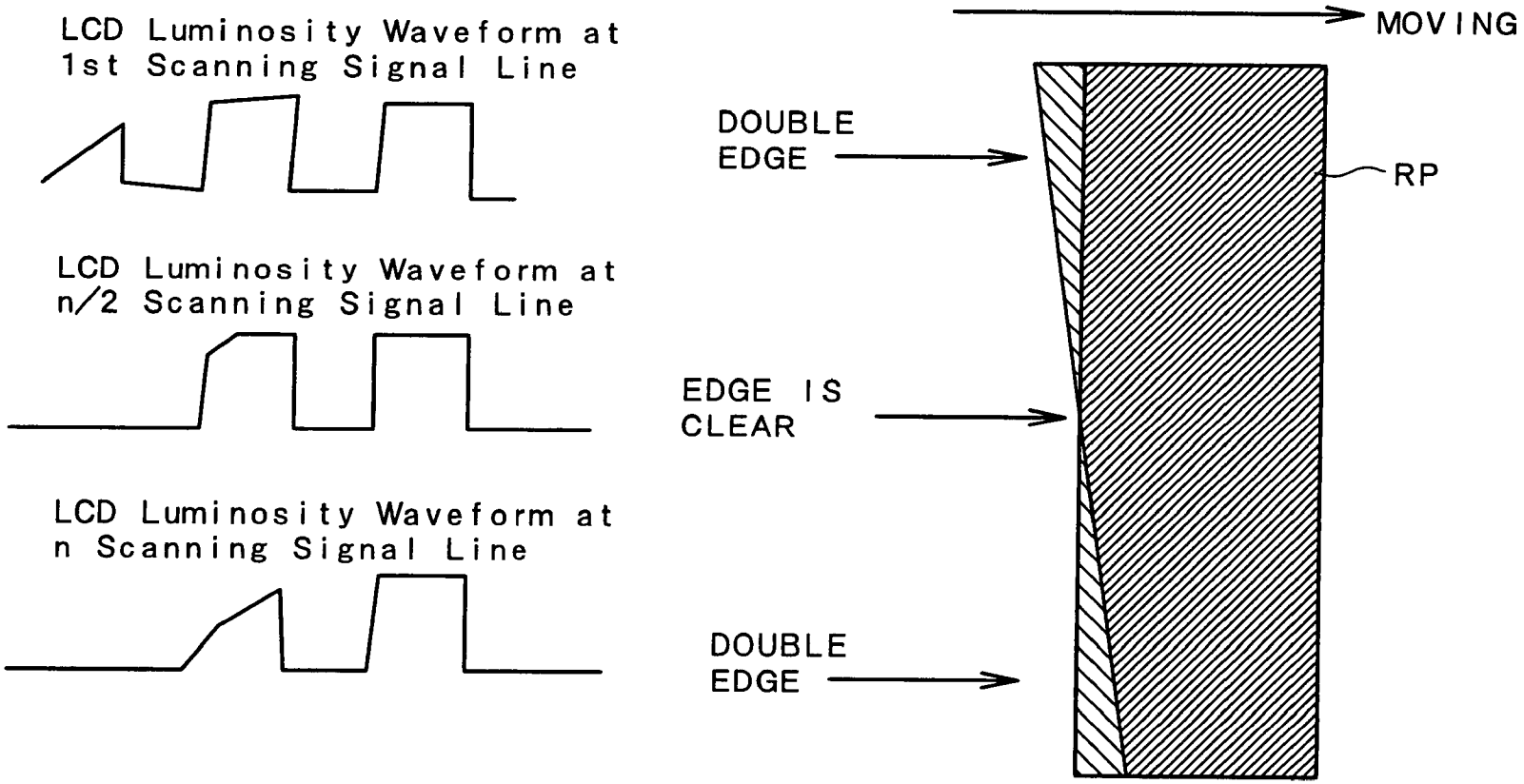
FIG. 16 is an explanatory view for explaining a reason for forming the constitution shown in FIG. 14.

As can be clearly understood from FIG. 15B, the pixel which is formed along the gate signal line GL at the uppermost stage exhibits the fast response of liquid crystal in appearance (compared with the response of liquid crystal which the pixel formed along the n/2 th gate signal line in the drawing exhibits), while the pixel which is formed along the gate signal line GL at the lowermost stage exhibits the delayed response of liquid crystal in appearance (compared with the response of liquid crystal which the pixel formed along the n/2 th gate signal line in the drawing exhibits). The corresponding relationship between FIG. 15B and FIG. 14 is shown in FIG. 16.

Accordingly, this embodiment is provided for suppressing the generation of shadows at the end sides of the image at the upper and lower sides of the screen. The embodiment is explained in conjunction with FIG. 17.

Figure 17A:
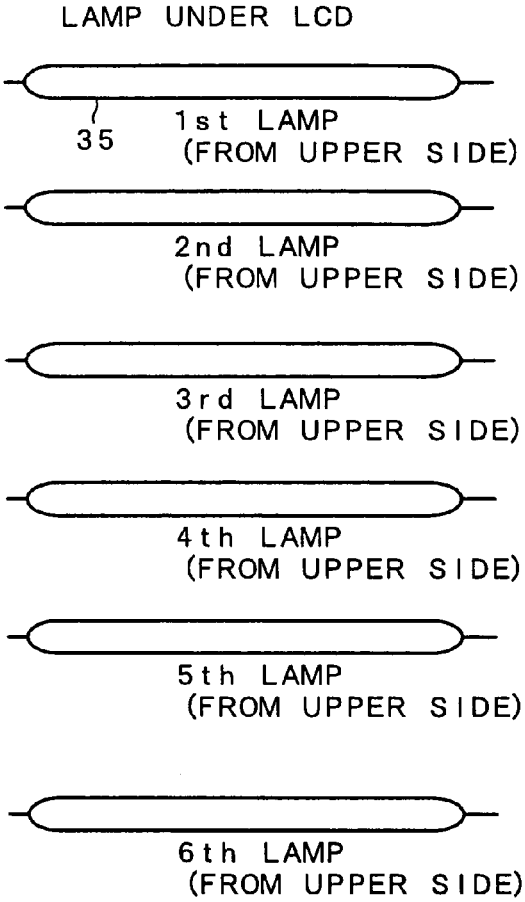
FIG. 17 is an explanatory view for showing another embodiment of the liquid crystal display device according to the invention.

FIG. 17A indicates respective light sources (lamps) 35 of the backlight. Here, the backlight having six light sources is provided.

The light source 35 of the uppermost stage (first light source) irradiates the upper side of the screen of the liquid crystal display device, the light source 35 of the lowermost stage (sixth light source) irradiates the lower side of the screen of the liquid crystal display device, and other respective light sources 35 irradiate the center portion of the screen.

Here, although the second to fifth light sources 35 are respectively driven to repeat the lighting and the extinguishing thereof in the above-mentioned respective embodiments, the first light source 35 and the sixth light source 35 are driven so as to maintain the lighting thereof.

Figure 17B:
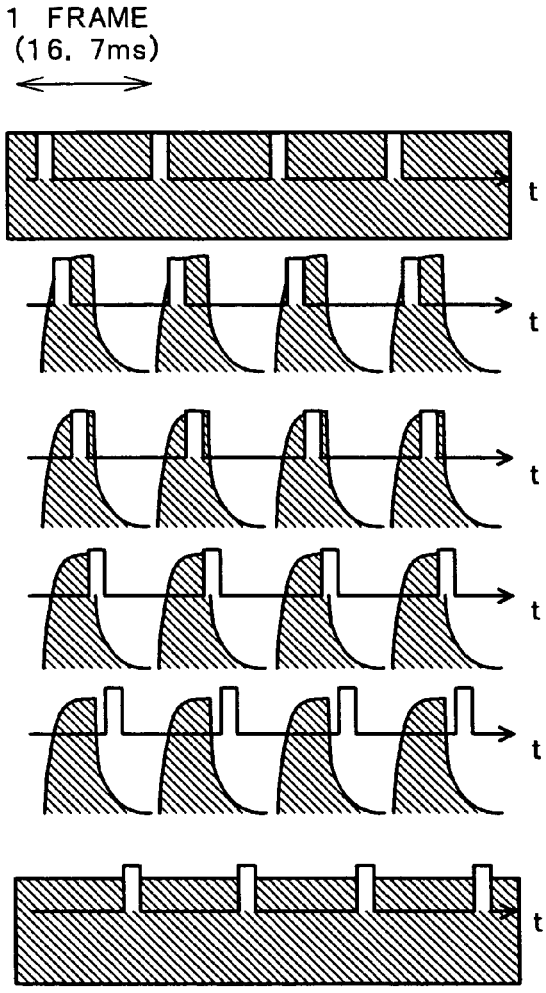

FIG. 17B shows the frames in which the lighting is performed along the time axis t corresponding to respective light sources 35 with a mesh. Further, FIG. 17B also shows the supply timing of scanning signals to the gate signal lines GL in the inside of the liquid crystal display panel which are formed at positions facing respective light sources 35 in an opposed manner.

Due to such a constitution, by always performing the lighting of the light source 35 at the upper portion and the lower portion of the screen, the fast response and the delayed response in appearance with respect to the response of liquid crystal can be eliminated.

Figure 18:
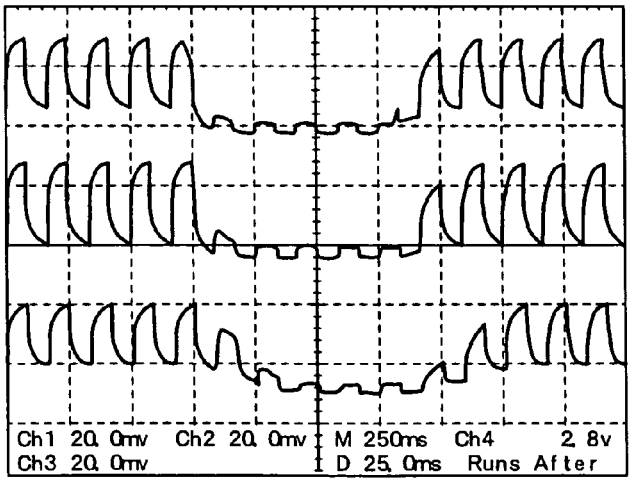
FIG. 18 is an experimental graph showing an advantageous effect of the embodiment shown in FIG. 17.

FIG. 18 is an experimental graph showing advantageous effects of this embodiment. That is, on the screen, photo diodes are respectively arranged at a portion which faces the first gate signal line GL, at a portion which faces the n/2 th gate signal line GL and at a portion which faces the nth gate signal line GL, and then outputs of respective photo diodes which are generated when the screen display is changed from white to black are observed using an oscillograph.

The characteristic graph of the upper stage indicates the output of the photo diode which is arranged at the position facing the first gate signal line GL in an opposed manner, the characteristic graph of the intermediate stage indicates the output of the photo diode which is arranged at the position facing the n/2 th gate signal line GL in an opposed manner, and the characteristic graph of the lower stage indicates the output of the photo diode which is arranged at the position facing the nth gate signal line GL in an opposed manner.

To focus on the change outputs of the respective photo diodes from white to black, it is confirmed that all of them are gentle and there exists no noteciable difference among waveform pulse amplitudes of respective photo diodes at the time of such a change. Incidentally, when the difference among the waveform pulse amplitudes is large, the difference is recognized as the difference of brightness by an observer and a double edge appears at an edge of an image pattern having the movement. Further, provided that their peak brightness is equal, when the integral values of brightness of respective frames are different, this also gives rise to a double edge.

In this embodiment, when the screen is divided, the screen is divided into an irradiation region for which the first light source 35 is responsible, irradiation regions for which the second to fifth light sources 35 are responsible, and an irradiation region for which the sixth light source 35 is responsible.

However, the division may be sufficient if the screen is divided into the center portion and both side portions thereof and the areas of these regions may be determined in an arbitrary manner.

For example, in the configuration shown in FIG. 17, screen may be divided into an irradiation region for which the first light source 35 is responsible, irradiation regions for which the second to fourth light sources 35 are responsible, and an irradiation region for which the fifth and the sixth light sources 35 are responsible.

As shown in FIG. 17B, with respect to the light sources 35 which repeat the lighting and the extinguishing, since the fall of the lighting is gentle, the lighting of the fifth light source 35 does not coincide with the scanning signal which is supplied to the gate signal line GL facing the fifth lighting source 35 in an opposed manner and hence, there may be a case that it is preferable to maintain the lighting also with respect to the fifth light source 35.

In the explanation of the embodiment described hereinafter, unless otherwise specified, the area of the each region defined by the difference of the lighting state of the light sources 35 is not specified and can be determined arbitrarily. Further, the number of the linear light sources is not specified and the lighting and the extinguishing may be repeated at the upper portion or the lower portion in place of the center portion.

Embodiment 6

Figure 19:
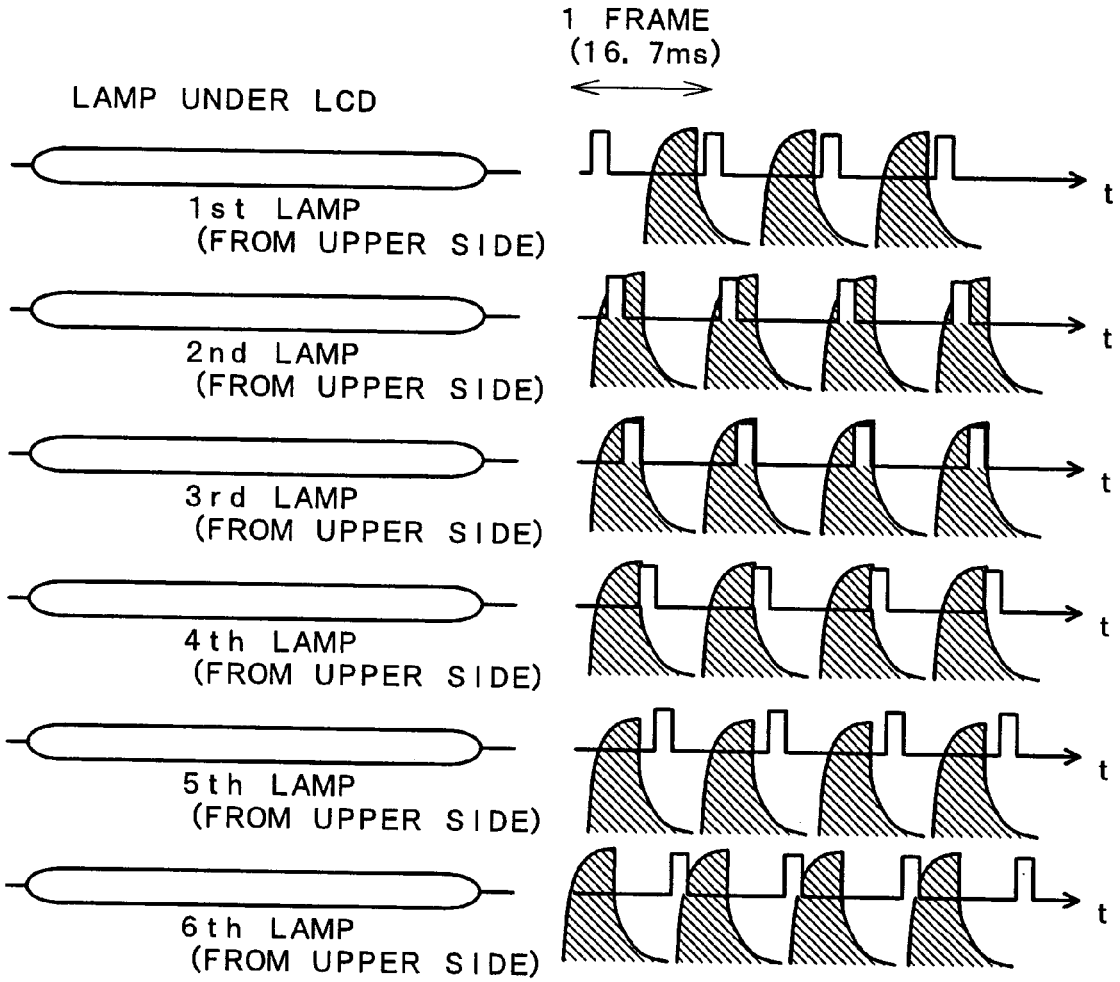
FIG. 19 is an explanatory view for showing another embodiment of the liquid crystal display device according to the invention.

FIG. 19 is an explanatory view showing another embodiment of the liquid crystal display device according to the present invention and this drawing corresponds to FIG. 17.

The constitution of this embodiment which differs from the constitution shown in FIG. 17 lies in that, first of all, the first light source 35 and the nth light source 35 are driven such that both of these light sources 35 repeat the lighting and the extinguishing.

Then, at the time of performing the sequential display of respective frames (images), at every frame, the respective light sources 35 which are arranged at the second to the fifth are made to repeat the lighting and the extinguishing without changing the phase, while the respective light sources 35 which are arranged at the first and the sixth are made to repeat the lighting and the extinguishing with the shift of phase.

Due to such a constitution, in the continuous display of respective frames, although the lighting and the extinguishing of respective light sources 35 which are arranged at the second to the fifth are performed at the timing shown in FIG. 17, the lighting of the respective light sources 35 which are arranged at the first and the sixth is performed so as to compensate for the extinguishing at the time of the display of preceding frames. Further, it is recognized that, at the time of display of the frame which comes after several frames or frames which follow such a frame, the light sources 35 which are arranged at the first and the sixth are always lit.

That is, in this embodiment, since the maintaining of the lighting of the light sources 35 which are arranged at the first and the sixth is performed from a time-sequential aspect, an advantageous effect obtained with respect to the embodiment 5 can be obtained.

Figure 20:
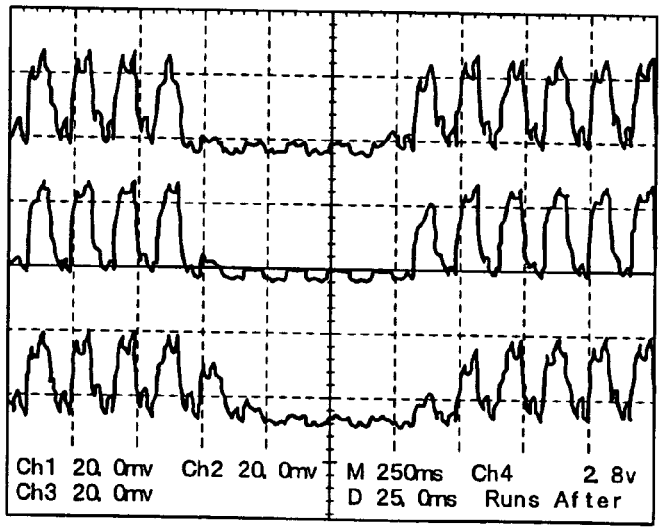
FIG. 20 is an experimental graph showing an advantageous effect of the embodiment shown in FIG. 19.

FIG. 20 is an experimental graph showing an advantageous effect of the embodiment which is obtained based on conditions similar to those of FIG. 18. It is clearly understood from FIG. 20 that characteristics similar to those shown in FIG. 18 can be obtained in this embodiment.

Embodiment 7

Figure 21:
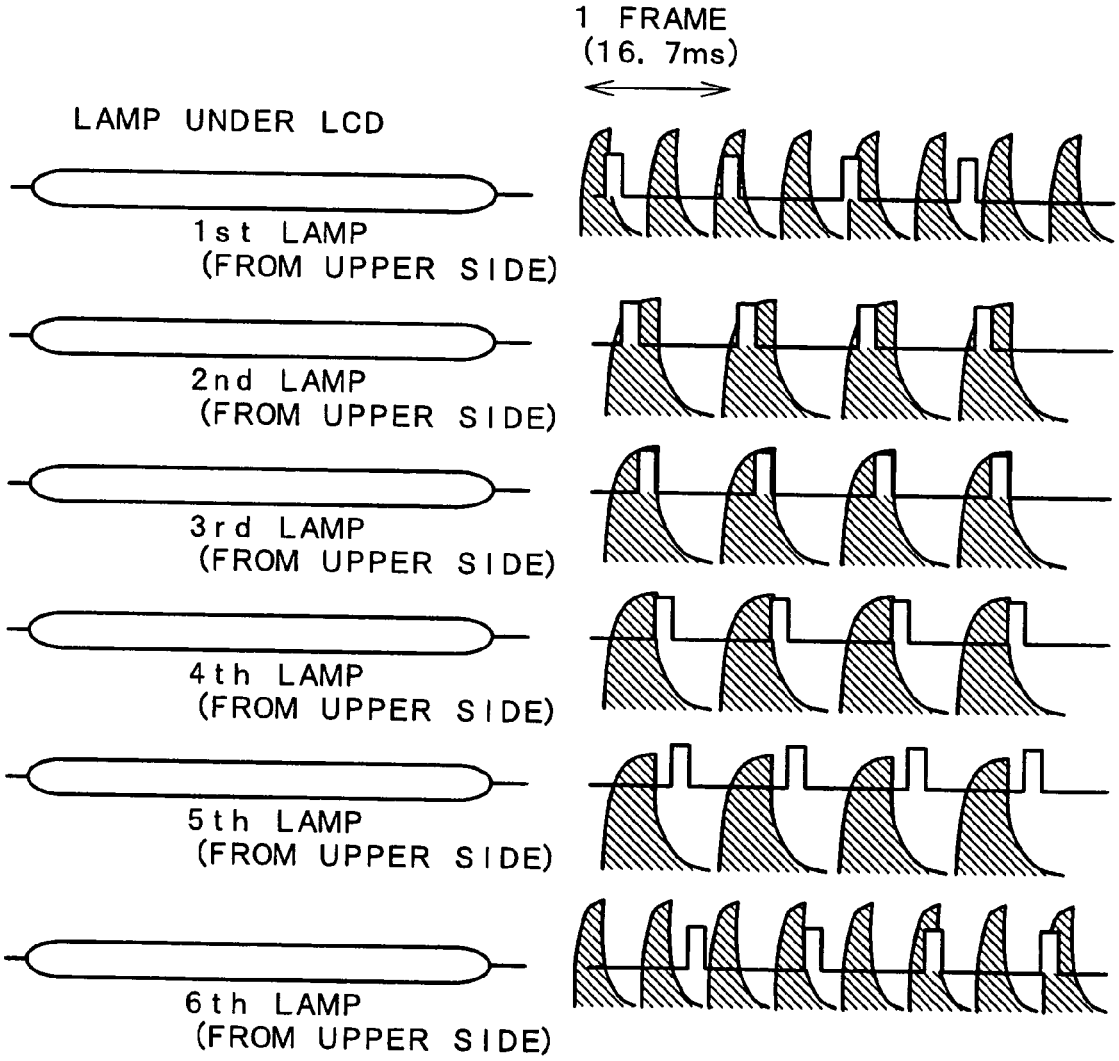
FIG. 21 is an explanatory view for showing another embodiment of the liquid crystal display device according to the invention.

FIG. 21 is an explanatory view showing another embodiment of the liquid crystal display device according to the present invention. FIG. 21 corresponds to FIG. 19.

The constitution of this embodiment which differs from the constitution shown in FIG. 19 lies in that the frequency of the lighting and the extinguishing of the first and sixth light sources 35 is set larger than the frequency of the lighting and the extinguishing of the second to fifth light sources 35.

In this case, the lighting and the extinguishing of respective first and sixth light sources 35 are performed such that the phase is not shifted every frame.

Due to such a constitution, the light from the second light source 35 is irradiated to the region where the first light source 35 is arranged and, further, the light from the fifth light source 35 is irradiated to the region where the sixth light source 35 is arranged so that the extinguishing times of the first and sixth light sources 35 are respectively compensated by the lightings of the second and fifth light sources 35.

Accordingly, it is recognized that the first and sixth light sources 35 substantially maintain the lighting state and an advantageous effect similar to those of the embodiments 5 and 6 can be obtained.

In this embodiment, although the lighting and the extinguishing of the first and sixth light sources 35 are performed without shifting the phase every frame, it is needless to say that the present invention is not limited to such a case and may include a case in which the phase is shifted every frame.

Embodiment 8

Figure 22:
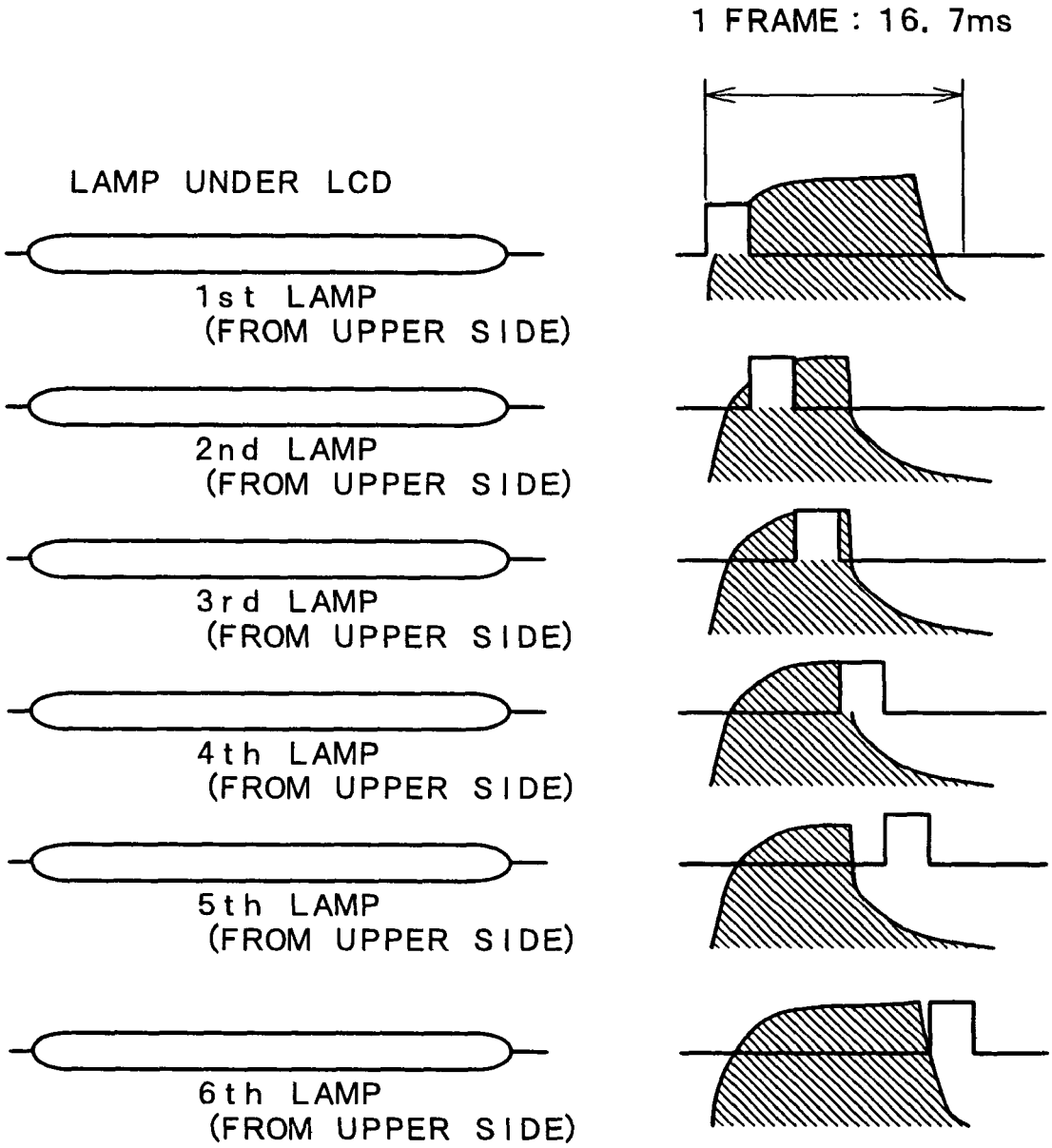
FIG. 22 is an explanatory view for showing another embodiment of the liquid crystal display device according to the invention.

FIG. 22 is an explanatory view showing another embodiment of the liquid crystal display device according to the present invention and constitutes a view which corresponds to FIG. 21. In FIG. 22, the lighting and the extinguishing of respective light sources 35 are exemplified with respect to only the first portions.

The constitution of this embodiment which differs from the constitution shown in FIG. 21 lies, first of all, in that the frame of the lighting and the extinguishing of the first and sixth light sources 35 is set equal to the frame of the lighting and the extinguishing of the second to fifth light sources 35 (for example, 60 Hz, 120 Hz, 180 Hz, 240 Hz).

Further, the duty of the lighting of the first and sixth light sources 35 is set larger than the duty of the lighting of the second and fifth light sources 35.

For example, it is preferable that the duty of lighting of the first and sixth light sources 35 is set to 70% and the duty of the lighting of the second and fifth light sources 35 is set to 50%.

Due to such a constitution, the first and the sixth light sources 35 can obtain a state which approximates the state in which the lighting is held and hence, an advantageous effect substantially equal to those of the embodiments 5 to 7 can be obtained.

Embodiment 9

FIG. 23 is an explanatory view showing another embodiment of the liquid crystal display device according to the present invention and constitutes a view which corresponds to FIG. 17. FIG. 23 also depicts the waveform of currents supplied to respective light sources 35.

Compared with the case shown in FIG. 17, the embodiment 9 is substantially equal with respect to the constitution that the first and sixth light sources 35 are driven while maintaining the lighting state. In this embodiment, however, the supply currents are set smaller than supply currents to respective second to fifth light sources 35. That is, due to such a constitution, the time integral value of the current is made equal at the center portion, at the upper portion as well as at the lower portion.

Figure 23A:
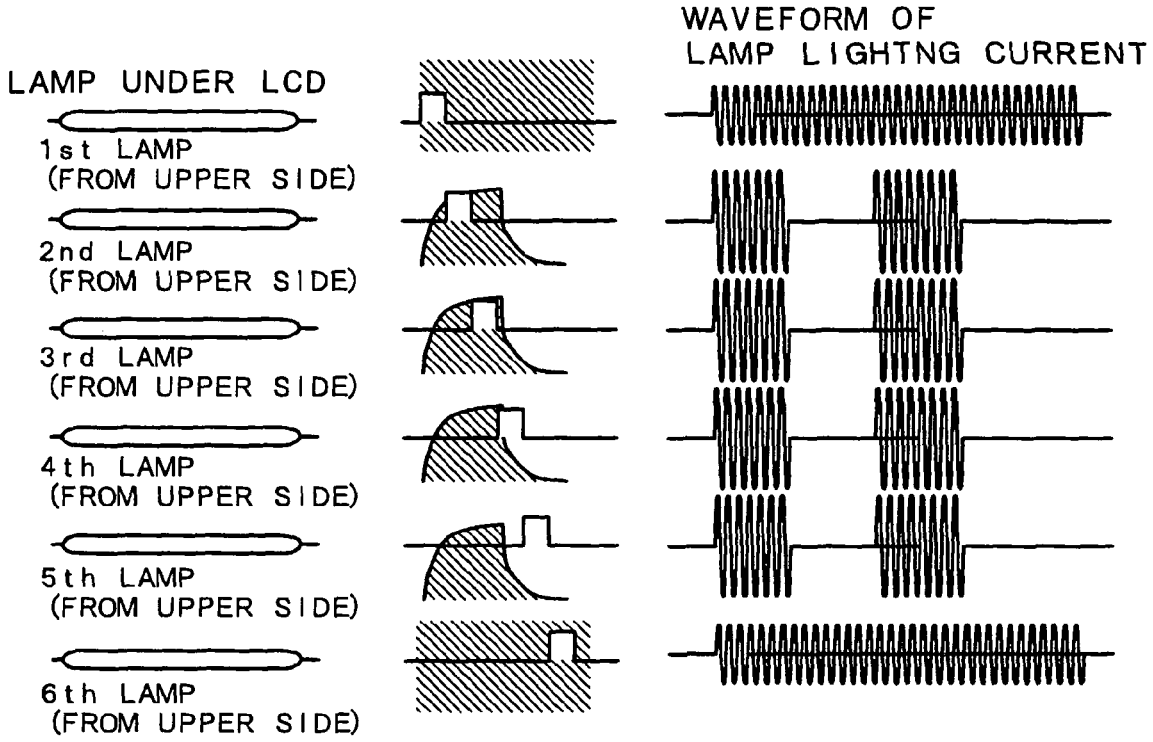
FIG. 23 is an explanatory view for showing another embodiment of the liquid crystal display device according to the invention.
Figure 23B:
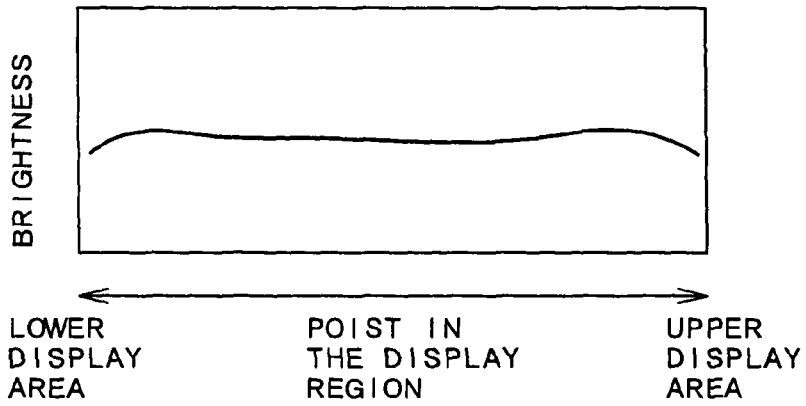

Accordingly, the brightness distribution of respective light sources 35 in the parallel direction (direction extending from a lower display area to an upper display area on the screen) becomes as shown in FIG. 23B so that the brightness is slightly decreased at the upper and lower display areas of the screen.

This is because that assuming that the supply current to the first and sixth light sources 35 is set equal to the supply current to the second to fifth light sources 35, the brightness is increased at the upper and lower display areas of the screen compared to the brightness at the center portion of the screen so that the discrimination (uniformity) of the display is deteriorated whereby the display quality is degraded.

Although the brightness of the light source 35 per se is decreased by decreasing the current in this embodiment, it is needless to say that in a case that the light source which decreases the brightness thereof by decreasing the voltage is used, the brightness is decreased by decreasing the voltage.

Embodiment 10

Figure 24A:
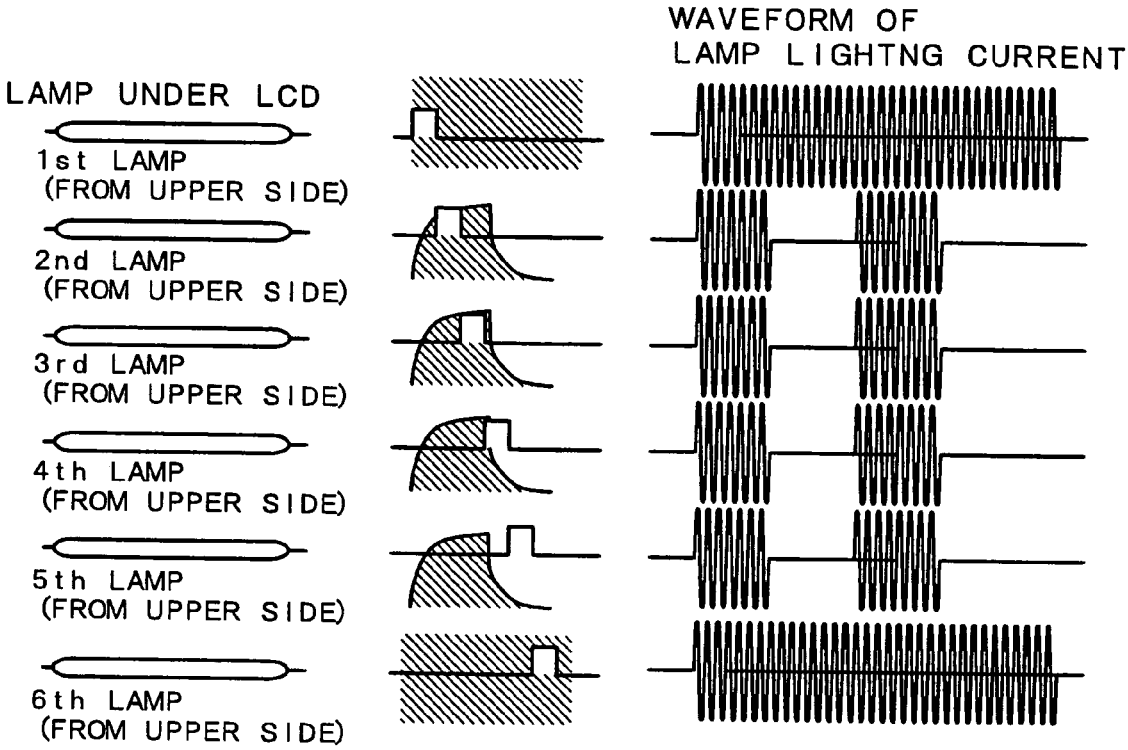
FIG. 24 is an explanatory view for showing another embodiment of the liquid crystal display device according to the invention.

FIG. 24A is an explanatory view showing another embodiment of the liquid crystal display device according to the invention and constitutes a view which corresponds to FIG. 23(*a*).

The constitution which differs from the constitution show in FIG. 23A lies in that a current which is supplied to the first and sixth light sources 35 is set substantially equal to a current which is supplied to the second to fifth light sources 35.

Figure 24B:
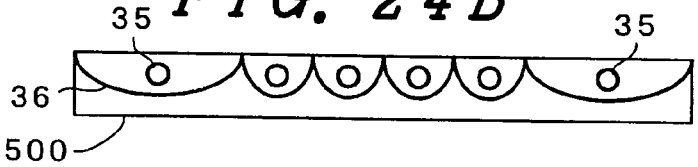

Then, as shown in FIG. 24B which constitutes a cross-sectional view of respective light sources 35 in the parallel direction, the first and sixth light sources 35 are spaced apart from other neighboring light sources 35 with an arrangement pitch which is larger than an arrangement pitch among the second to fifth light sources 35.

Due to such a constitution, since the first and sixth light sources 35 have to be respectively responsible for the irradiation of light to regions having relatively large areas, the brightness in appearance can be decreased.

Figure 24C:
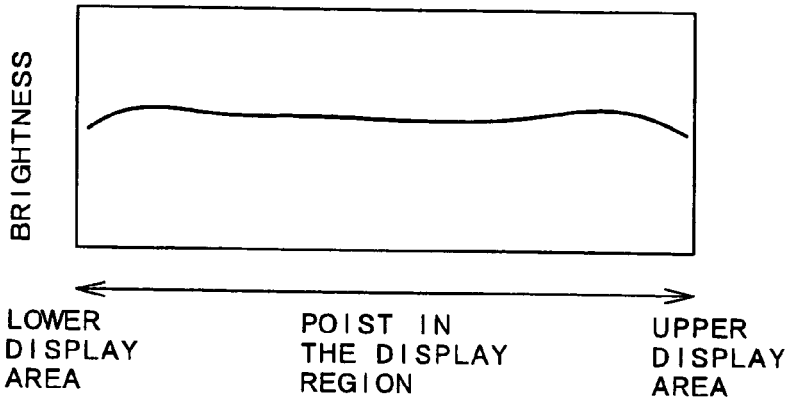

Then, the distribution of brightness of respective light sources in the parallel direction (direction from the lower display area to the upper display area) can be set as shown in FIG. 24C so that an advantageous effect substantially equal to the advantageous effect exhibited in the embodiment 9 can be obtained.

In this embodiment, as the light sources which maintain the lighting, one light source is arranged at the upper portion and one light source is arranged at the lower portion. However, even when two or three light sources are arranged at each portion, the arrangement pitch of the light sources such portions may be set larger than the arrangement pitch of the light sources at the center portion. Further, the arrangement pitch does not depend on the cross-sectional shape of the light sources.

Embodiment 11

Figure 25A:
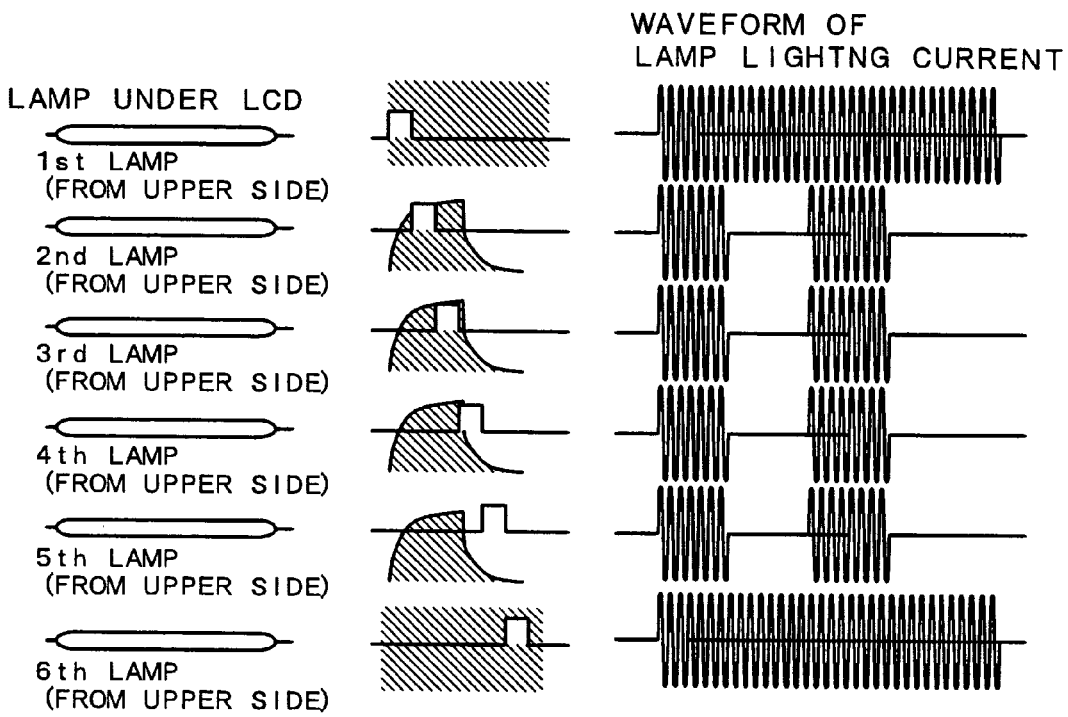
FIG. 25 is an explanatory view for showing another embodiment of the liquid crystal display device according to the invention.
Figure 25B:
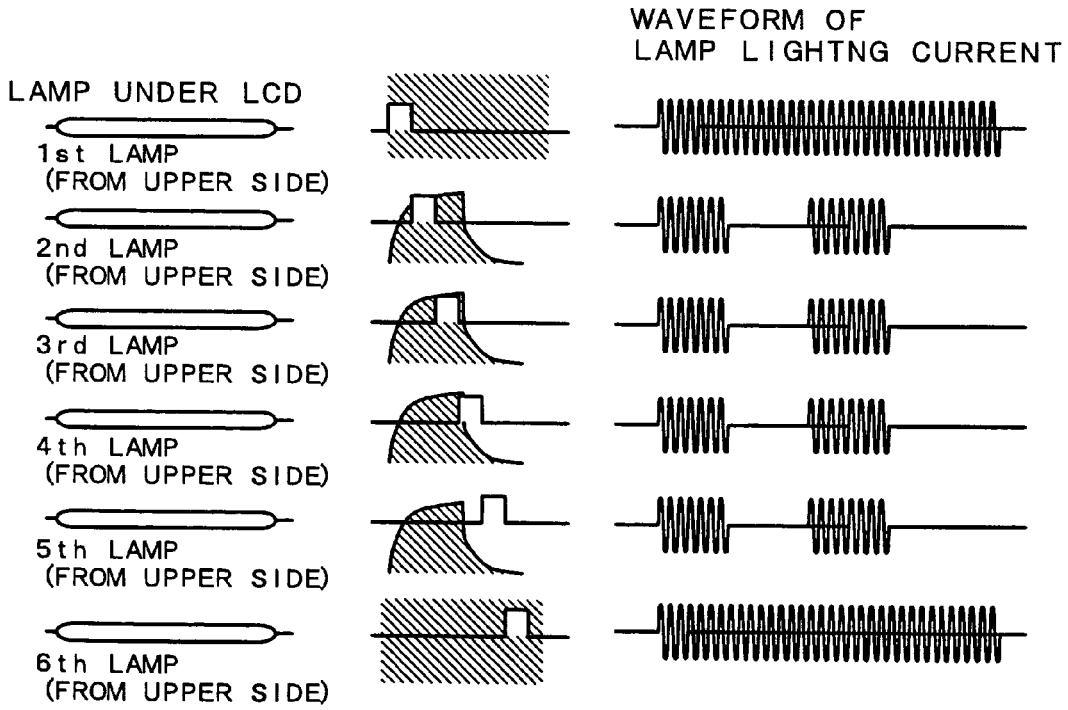

FIG. 25 is an explanatory view showing another embodiment of the liquid crystal display device according to the invention and constitutes a view which corresponds to FIG. 17.

The constitution of the embodiment which differs from the constitution shown in FIG. 17 is that the magnitudes of currents supplied to respective light sources 35 can be controlled. The currents are increased in FIG. 25A and the currents are decreased in FIG. 25B.

To be more specific, this can be achieved by interposing current control means between respective light sources 35 and a power source device which supplies electricity to respective light sources 35.

Due to such a constitution, an advantageous effect that the brightness of the whole screen can be adjusted can be obtained.

As still another embodiment, it may be possible that the magnitudes of the currents supplied to the first light source 35 and the sixth light source 35 are independently controlled or the magnitudes of the currents supplied to the second to fifth light sources 35 are independently controlled. In this case, the magnitudes of the currents can be adjusted in such a manner as shown in FIG. 23.

Further, when the brightness is changed by controlling the magnitudes of voltages supplied to respective light sources 35, the magnitudes of the respective supply voltages may be controlled.

Embodiment 12

FIG. 26 is an explanatory view of another embodiment of the liquid crystal display device according to the present invention. The embodiment is characterized in that the duties of lightings of the first and sixth light sources 35 and the duties of lightings of the second to fifth light sources 35 are also controlled.

Figure 26A:
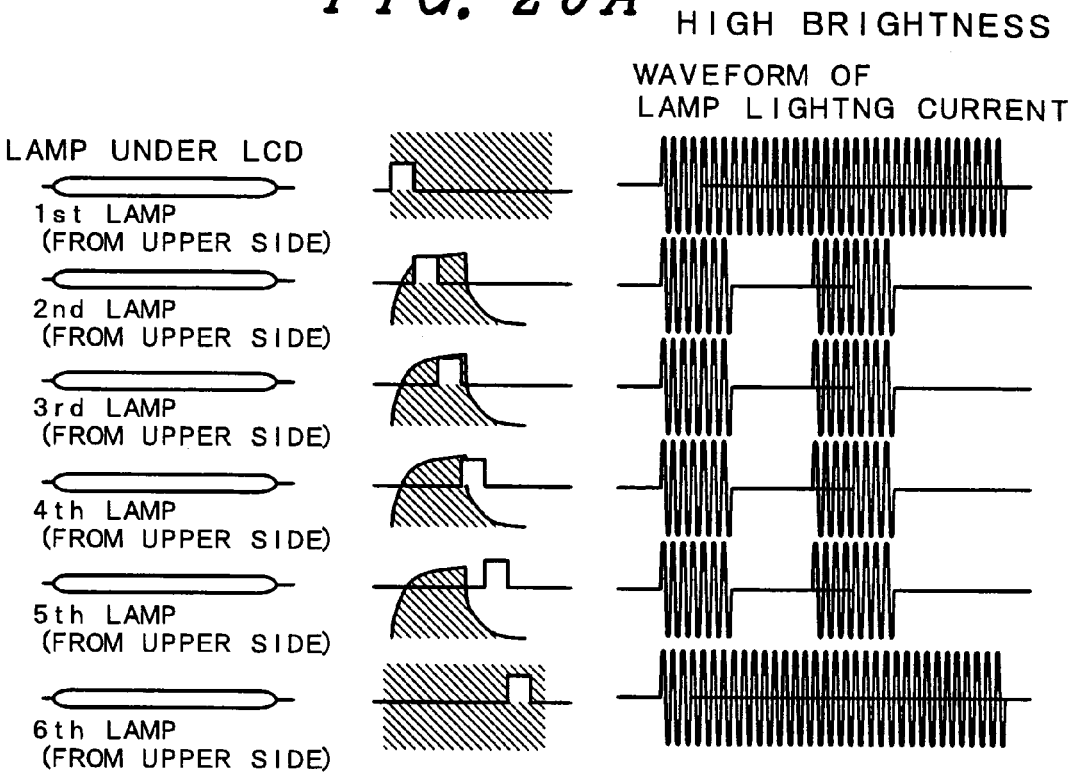
FIG. 26 is an explanatory view for showing another embodiment of the liquid crystal display device according to the invention.
Figure 26B:
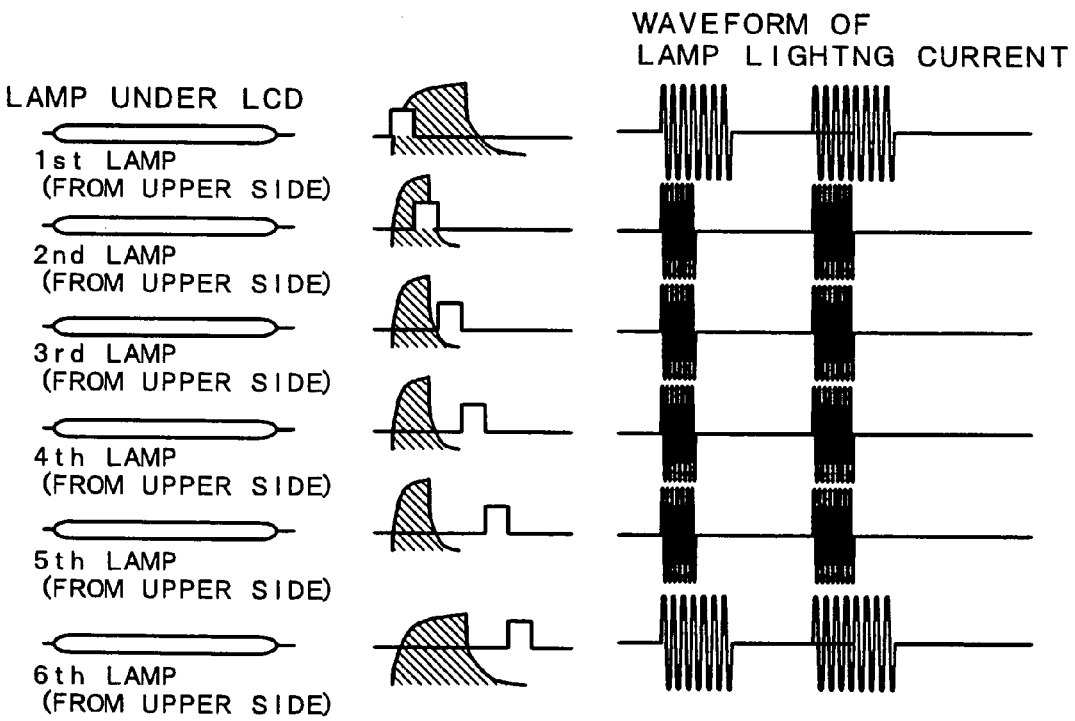

For example, the duties of the lightings of the first and sixth light sources 35 are adjusted to 100% and the duties of the lightings of the second to fifth light sources 35 are adjusted to 50% in FIG. 26A, while the duties of the lightings of the first and sixth light sources 35 are adjusted to 50% and the duties of the lightings of the second to fifth light sources 35 are adjusted to 25% in FIG. 26B. Even with such a constitution, an advantageous effect that the brightness of the whole screen can be adjusted is obtained.

As still another embodiment, it may be possible that the duties of lightings of the first and sixth light sources 35 are independently controlled or the duties of lightings of the second to fifth light sources 35 are independently controlled. In this case, the duties of the lightings can be controlled as shown in FIG. 22.

Embodiment 13

FIG. 27 is an explanatory view of another embodiment of the liquid crystal display device according to the present invention and constitutes a view which corresponds to FIG. 26.

The constitution of the embodiment which differs from the constitution shown in FIG. 26 lies in that a quiescent frame is interposed between the lighting frames of the second and fifth light sources 35.

Due to such a constitution, the flickering which may be generated with respect to images on the screen can be drastically suppressed.

Figure 27A:
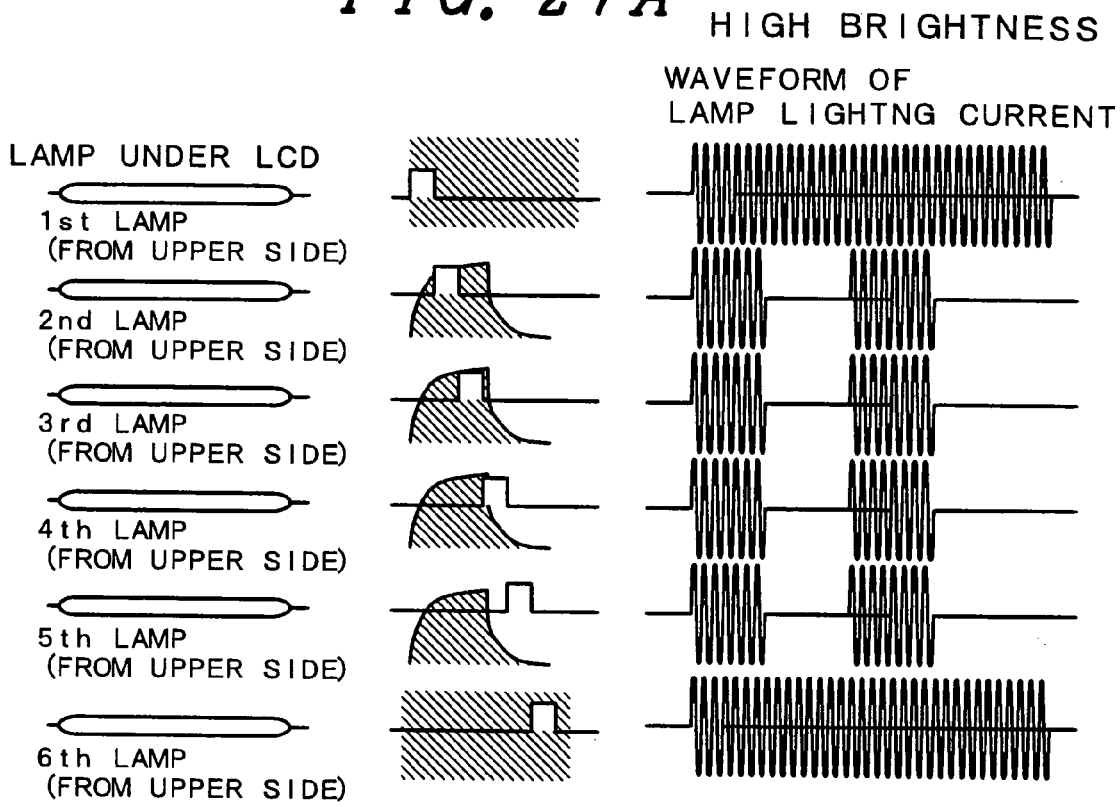
FIG. 27 is an explanatory view for showing another embodiment of the liquid crystal display device according to the invention.
Figure 27B:
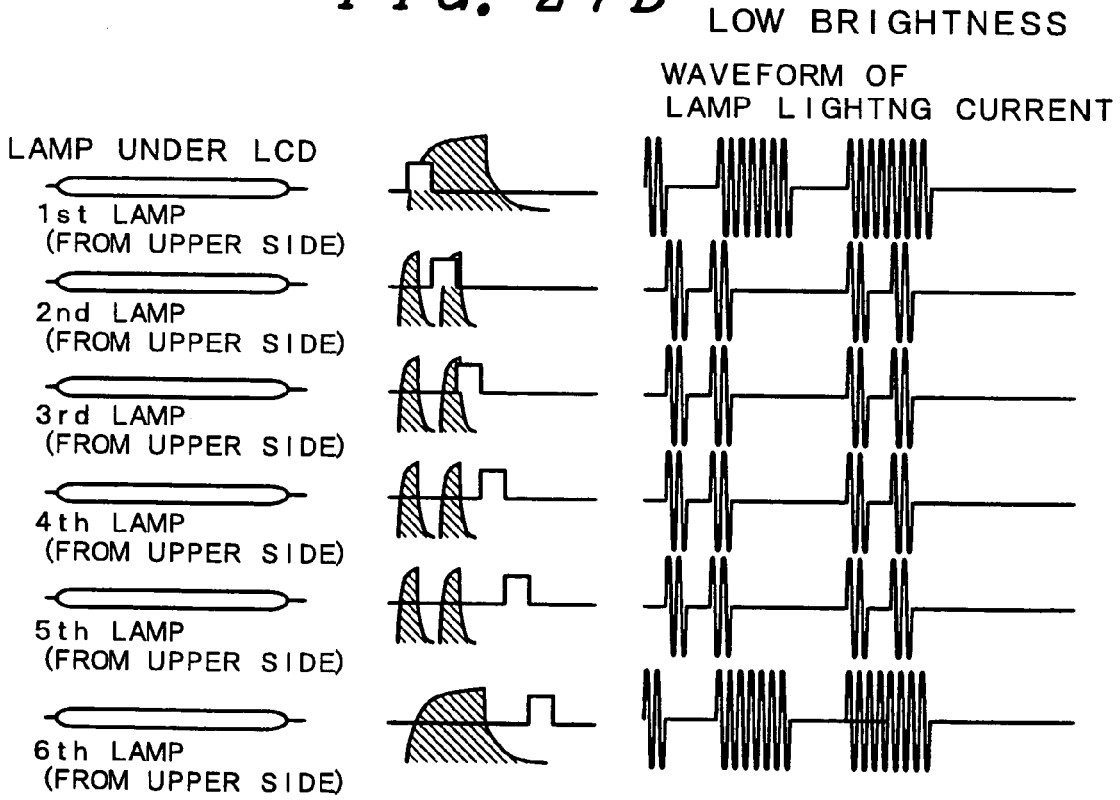

The flickering which may be generated with respect to images on the screen can be also suppressed by repeating the lightings sequentially such that the lightings of respective light sources 35 are performed in a mode shown in FIG. 27A at the time of displaying images in one frame, then the lightings of respective light sources 35 is performed in a mode shown in FIG. 27B at the time of displaying images in the next frame, and the lightings of respective light sources 35 is performed in a mode shown in FIG. 27A at the time of displaying images in the still next frame.

In the above-mentioned explanation of the embodiments 5 to 13, the lighting states of light sources which face the center region of the screen in an opposed manner and to both side regions (upper and lower regions) of the screen are made different from each other. However, it is needless to say that the lighting state of the light source which faces at least one of both side regions (upper or lower region) in an opposed manner and the lighting state of the light source which faces other region including the center region in an opposed manner are made different from each other.

However, in any one of the constitutions of the embodiment 1 to 13, the application and the non-application of lighting can be changed over due to processing such as image processing or processing using either a hardware switch or a software switch or the like.

This is because, in such a case, by adopting the full lighting at the time of PC screen and adopting any one of the constitutions of the embodiments 1 to 13 at the time of motion picture screen, it becomes possible to obtain the improvement of the image quality of the still picture and the image quality of the motion picture such that they are compatible with each other at a high level. Particularly, it is effective for reducing flickering at the time of the still picture frame.

It is needless to say that this is not restricted to the concept disclosed in the embodiments 1 to 13 and is effective to any constitution which includes the state in which the lighting and the extinguishing of the backlight is displayed repeatedly.

Embodiment 14

Figure 28A:
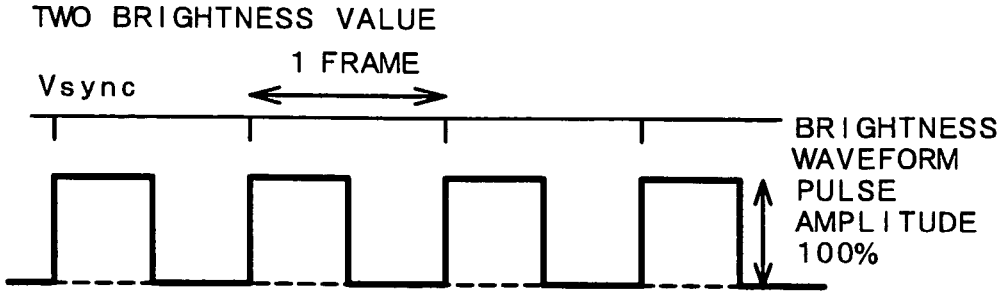
FIG. 28 is an explanatory view for showing another embodiment of the liquid crystal display device according to the invention.

In some of the above-mentioned embodiments, when the lighting and extinguishing of respective lights are repeated, the lighting and the extinguishing are made synchronous with the scanning signal which is supplied with to the gate signal line 3. In this embodiment, however, as shown in FIG. 28A, within a period between one synchronous signal and a next synchronous signal (defined as a frame, 60 Hz, 16.7 Ms), one lighting having an amount of light of the brightness waveform pulse amplitude set to 100% and one extinguishing having an amount of light of the brightness waveform pulse amplitude set to 0% are present.

However, it is needless to say that the liquid crystal display device may be driven such that, in the above-mentioned lighting frame, an amount of light of the initial brightness waveform pulse amplitude is set to 100% and then an amount of light of the brightness waveform pulse amplitude is set to an amount of light below the above-mentioned amount of light, for example, an amount of light of the brightness waveform pulse amplitude which is set to 50%. It is sufficient that the extinguishing frame is present to achieve the object of the invention.

In this case, when the fall is slow with respect to the response speed of the liquid crystal, it becomes effective to repeat such extinguishing.

Figure 28B:
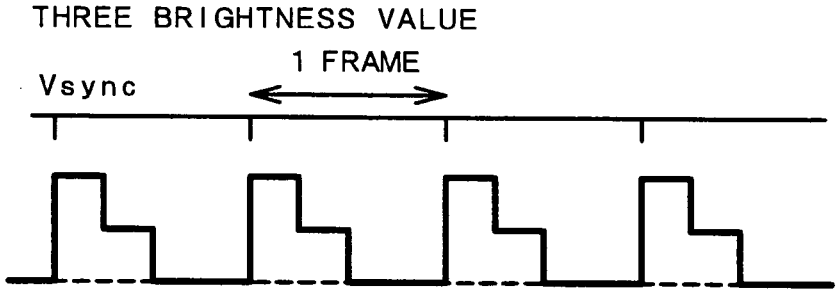
Figure 28C:
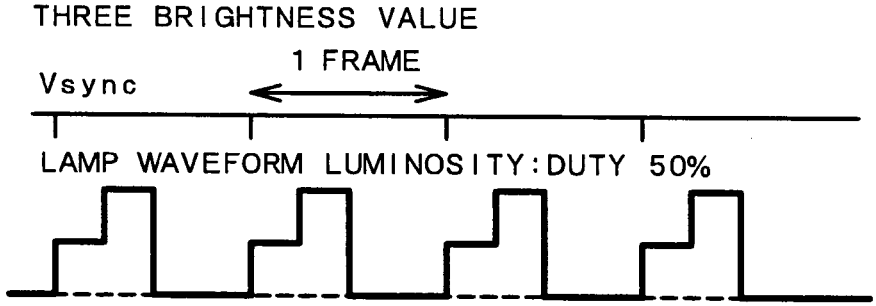

From this aspect, it is needless to say that the liquid crystal display device may be driven such that, in the frame of lighting, the amount of light of the brightness waveform pulse amplitude is set to approximately 50% and then is set to 100% as shown in FIG. 28C.

In this case, when the rise is slow with respect to the response speed of the liquid crystal, it becomes effective to repeat such extinguishing.

Figure 28D:
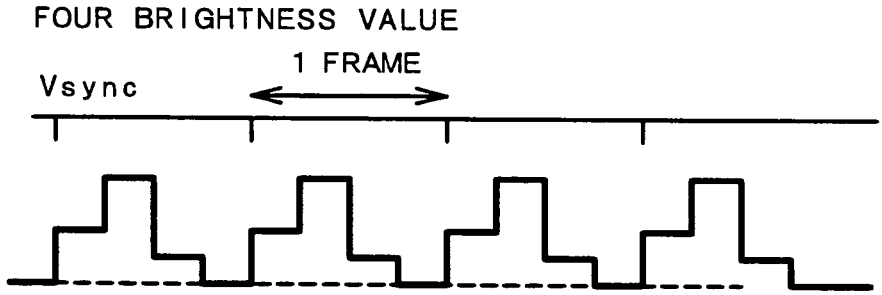

Further, it is needless to say that the liquid crystal display device may be driven such that, in the frame of lighting, the amount of light of the brightness waveform pulse amplitude is initially set to any value within a range of 100 to 0% and then the amount of light of the next brightness waveform pulse amplitude is set to 100%, and further, the amount of light of the next brightness waveform pulse amplitude is set to any value within a range of 100% to 0%, as shown in FIG. 28D.

In this case, when there exists the difference between the rise and the fall with respect to the response speed of the liquid crystal, it becomes effective to repeat such extinguishing. Further, this is also effective to enhance the uniformity of the screen.

Figure 29:
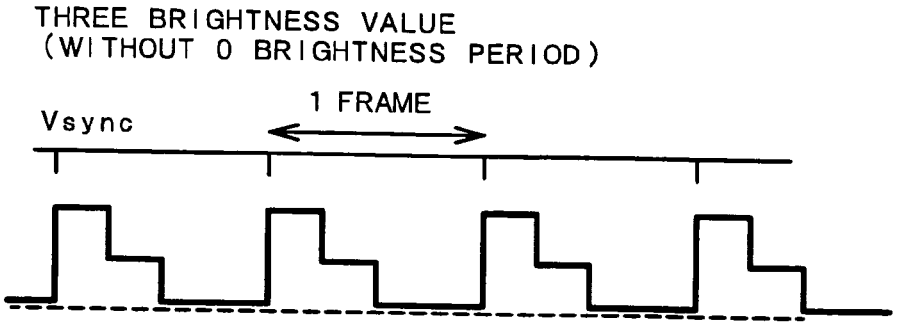
FIG. 29 is an explanatory view for showing another embodiment of the liquid crystal display device according to the invention.

FIG. 29 shows a modification of the embodiment shown in FIG. 28B. As shown in the drawing, it is not always necessary to set the brightness waveform pulse amplitude to 0% at the time of extinguishing light and may be set to a value close to 0% (for example 5%).

In such a case, the brightness at the time of next lighting can be enhanced due to preheating at the time of extinguishing light and hence, it is particularly effective to the liquid crystal display device at a low temperature or immediately after starting the supply of electricity from the power source.

It is needless to say that this is applicable to the driving shown in FIG. 28A, FIG. 28C and FIG. 28D.

Further, although a plurality of states in which an amount of light differs from each other are present with respect to the lighting of light source 35, it is needless to say that the proportion of these states with respect to time can be freely controlled. In the lighting, when respective light amounts of three brightness value are changed along with the lapse of time, for example, a case in which the time of the first amount of light is controlled, a case in which the time of the first amount of light and the time of a next amount of light are controlled, and a case in which the times of respective amounts of light are controlled or the like are considered. In short, at least an amount of light of any one value may be controlled whereby the proper distribution of an amount of light can be realized.

This is substantially equal to the technical concept of the above-mentioned embodiments that the optimum state is obtained by changing the duties of lighting and extinguishing.

Embodiment 15

In repeating the lighting and the extinguishing of the light sources 35 shown in the embodiment 14, when an amount of light of the lighting is time-sequentially changed, such a change is performed in a step-like manner.

Figure 30:
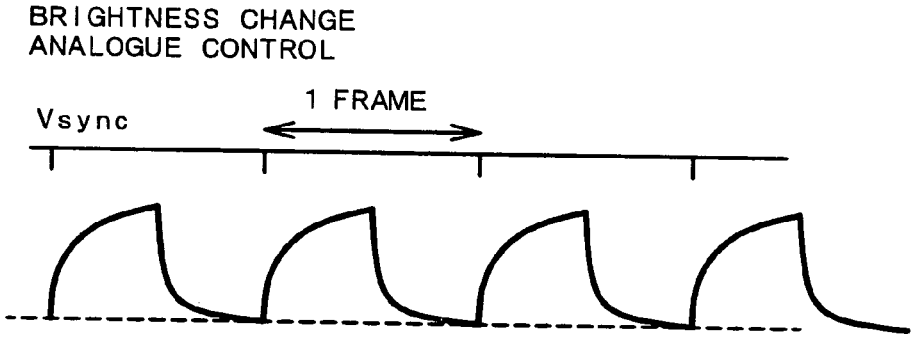
FIG. 30 is an explanatory view for showing another embodiment of the liquid crystal display device according to the invention.

However, it is needless to say that, as shown in FIG. 30, an amount of light of the lighting may be continuously changed in an analogue manner.

When cold cathode ray tubes or light emitting diodes are used as the light sources 35, they give rise to the delay of 2 to 3 ms with respect to the rise of the brightness and further exhibit the synchronous afterglow characteristics and hence, the brightness value which is changed time-sequentially takes the analogue continuous shape but the step-like shape.

Accordingly, by performing the lighting of the light sources 35 shown in FIG. 30, the natural motion picture characteristics can be obtained along with the fact that the rise and fall characteristics of the response of the liquid crystal have the response time of several ms to 10 ms.

Embodiment 16

In the above-mentioned respective embodiments, when the lighting and the extinguishing of light sources 35 are repeated, the repeating is synchronized with the scanning signal supplied to the gate signal line 3, for example.

However, to take the fact that the observation of the liquid crystal display device is performed through human eyes, even when the slight delay is generated among frames, no problem occurs so long as the time mean value is substantially fixed. The perception of the brightness with human eyes is performed based on the integration of time of every several ms.

Figure 31:
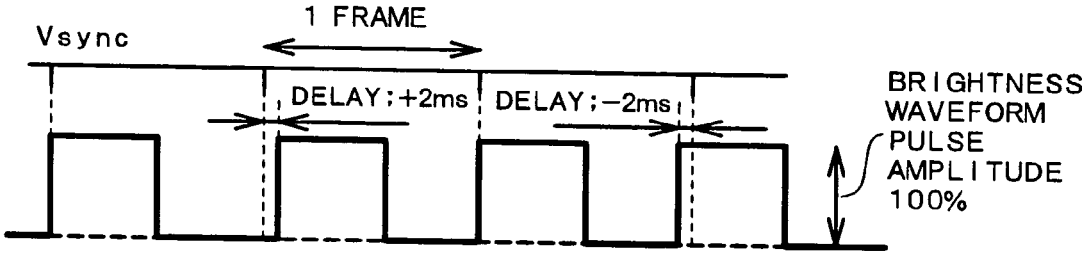
FIG. 31 is an explanatory view for showing another embodiment of the liquid crystal display device according to the invention.

In view of the above, as shown in FIG. 31, for example, even when delays of +2m and −2m are generated with respect to some of the rises of the lighting in respective frames, the object of the invention can be sufficiently obtained.

This is because that, as shown in FIG. 31, when the gate writing start time and the lighting start time agree in the first frame, the delay of +2 ms is generated in the next frame, the delay becomes 0 in the subsequent next frame, and the delay of −2 ms is generated in still subsequent next frame, the delay becomes substantially 0 from a viewpoint of the time mean value so that no change occurs with respect to the brightness perceived by the human.

Embodiment 17

Further, since the observation of the liquid crystal display device is performed using the human eyes as mentioned above, the agreement of the gate writing start time and the lighting start time of the light source 35 is a matter of degree and hence, it should not be interpreted in a strict sense.

Figure 32:
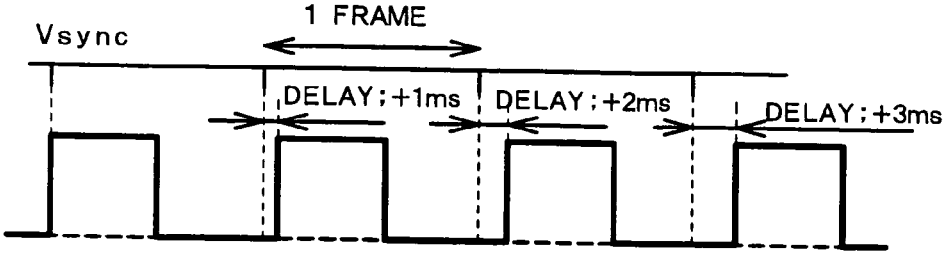
FIG. 32 is an explanatory view for showing another embodiment of the liquid crystal display device according to the invention.

In view of the above, it is needless to say that, as shown in FIG. 32, there may be a case in which the gate writing start time and the lighting start time agree in the first frame, the delay becomes +1 ms in the next frame, the delay becomes +2 ms in the subsequent next frame, and the delay of +3 ms is generated in still subsequent next frame. For example, based on the experimental rule, so long as the delay is within +8 ms and −8 ms, the object of the invention can be sufficiently achieved.

This is because that, when the one frame is 60 Hz, so long as the delay is at the above-mentioned degree, it is regarded that the gate writing start time and the lighting start time of the light source 35 agree with each other.

Figure 33:
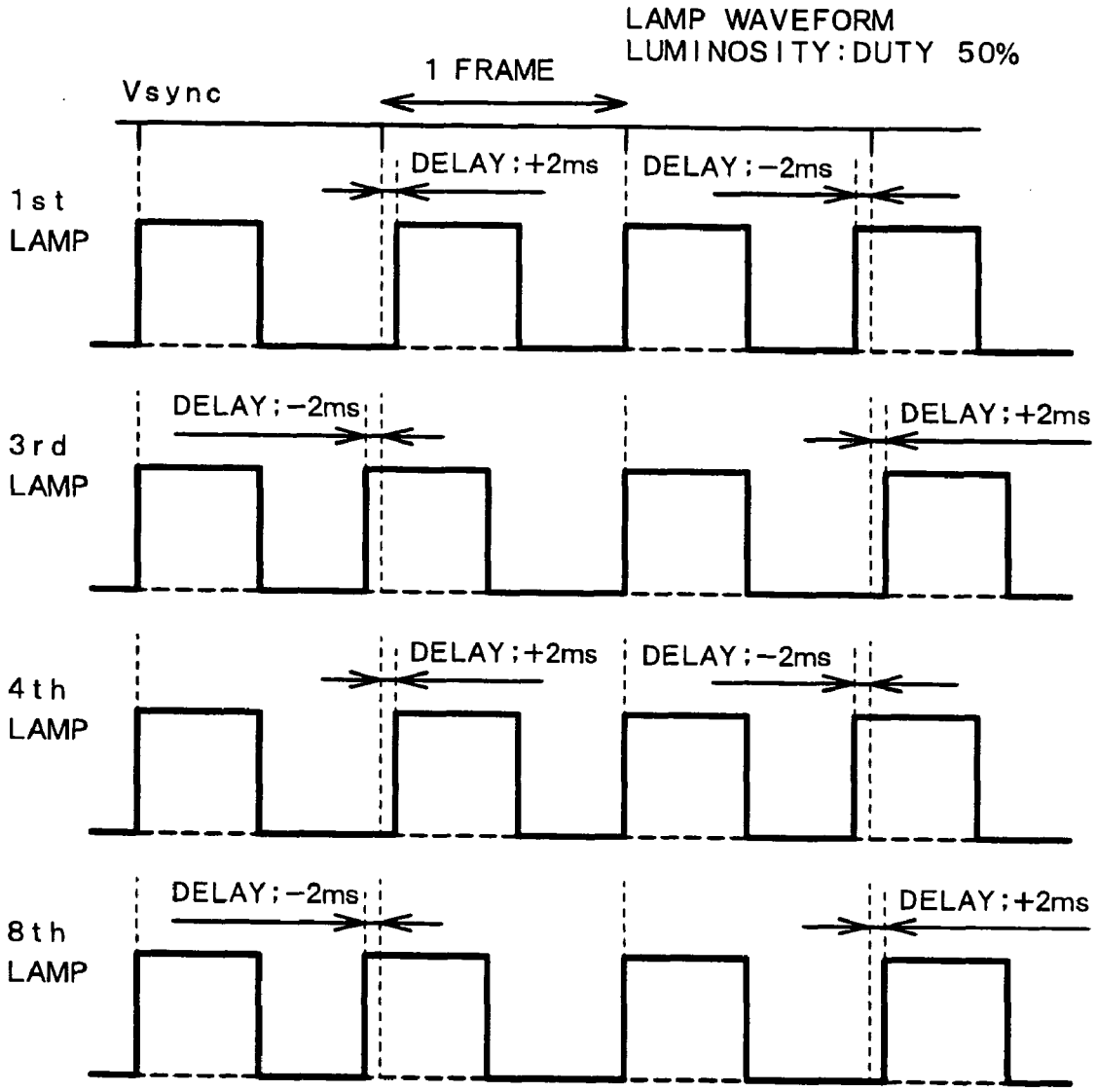
FIG. 33 is an explanatory view for showing another embodiment of the liquid crystal display device according to the invention.

Further, as shown in FIG. 33, with respect to a plurality of light sources (lamps) 35, even some of them (the lamp 1 and the lamp 8 in the drawing) have delays at respective frames thereof, the object of the present invention can be achieved.

Figure 34:
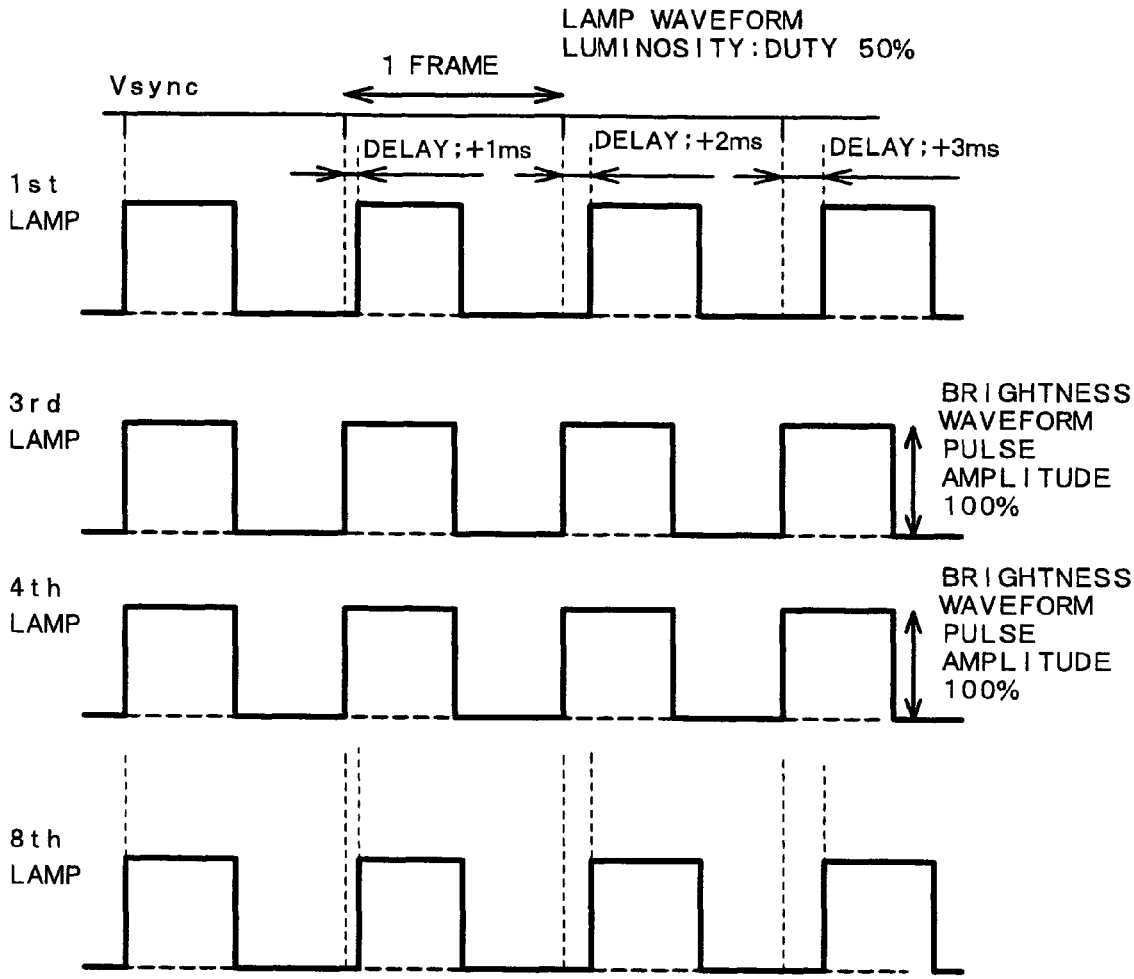
FIG. 34 is an explanatory view for showing another embodiment of the liquid crystal display device according to the invention.

Further, as shown in FIG. 34, even when a plurality of light sources 35 have delays at specific frames thereof and these delays are different from each other, the object of the invention can be achieved.

Embodiment 18

In the above-mentioned embodiments, assuming that the gate writing frame is 60 Hz, even when the delay is generated several times in 1 second (corresponding to 61, 62, 58 or 59 Hz), this arises no discomfort in the observation of display. Accordingly, it is needless to say that such a case can also achieve the object of the invention.

Embodiment 19

It is confirmed that, in the above-mentioned respective embodiments, when the gate writing frame and the lighting frame of the light source 35 are integer times different from each other, that is, when the gate writing frame is 60 Hz and the lighting frame of the light source 35 is 120 Hz, for example, it gives rise to no discomfort in the observation of display.

Embodiment 20

The above-mentioned respective embodiments refer to the liquid crystal display device of the so-called lateral electric field type which has been known as a liquid crystal display device having a wide viewing angle. The liquid crystal display device of this type has the characteristic that the difference between the black-and-white response and the half tone response is small and is extremely effective in the motion picture display such as a television or a movie which includes a large number of half tone displays.

Further, in the liquid crystal display device of the lateral electric field type, the liquid crystal molecules are oriented in parallel with a surface of a substrate and the orientation is changed due to an electric field parallel to the surface of the substrate. However, it is needless to say that the present invention is applicable to a liquid crystal display device of a so-called longitudinal electric field with such a mode.

Such a liquid crystal display device exhibits the fast black-and-white response characteristics so that the device is further effective in the display of motion pictures.

Further, there arises no problem at all even when ferroelectric liquid crystal such as smectic liquid crystal is used in place of nematic liquid crystal.

Embodiment 21

Further, it is needless to say that the invention is applicable to a liquid crystal display device of a TN mode which is of a longitudinal electric field type and has liquid crystal molecules which are oriented parallel to a surface of a substrate (with a slight tilting angle) and has a twisted structure.

This liquid crystal display device exhibits the fast black-and-white response characteristics and hence is effective in the display of motion pictures. Further, there arises no problem even when the present invention is applied to a liquid crystal display device of a vertical orientation type.

Embodiment 22

Although the respective embodiments are explained heretofore on the condition that gate writing frame is set to 60 Hz, it is needless to say that, when data scanning is performed several times within the period of this frame, it is possible to adopt a method in which the scanning is performed twice, for example, with a scanning period of 120 Hz, the writing of a display signal is performed at the first time and the black display data is written in the second time.

In this case, by blinking the light source 35 at 60 Hz such that the light source 35 extinguishes light at the time of writing the black data, the black frame of the light source 35 becomes clearer thus providing the favorable display of motion pictures.

It is needless to say that, as a method for blinking the light sources 35, it becomes possible to adopt a method in which respective light sources 35 are subjected to scan blinking in synchronism with data scanning, a method in which the light sources 35 are divided into an upper group and a lower group and they are alternately blinked or a method in which the light sources 35 are blinked as a whole with the lighting duty of not less than 40%.

Although the brightness ratio of blinking of the light source 35 may adopt bright-and-dark two values made of 100% brightness and 0% brightness, it is not always necessary to set one brightness to 0% to perform the writing of black data. For example, by setting one brightness to 50%, the similar advantageous effect can be obtained. The blinking of the light sources 35 is performed for achieving a cooling effect during the light extinguishing time and hence, provided that the electric power efficiency is favorable, it is not always necessary to set the brightness to 0 and the electric power for light sources to 0.

Embodiment 23

Among the above-mentioned embodiments, there exist some embodiments in which the discrimination of the motion pictures is enhanced by detecting the movement of the image and thereafter changing the duty of the repeatedly performed lighting and extinguishing of the light sources 35 in response to the movement.

However, it is needless to say that it is possible to generate the change of the duty using electric signals which are different from the above-mentioned electric signals.

Figure 35A:
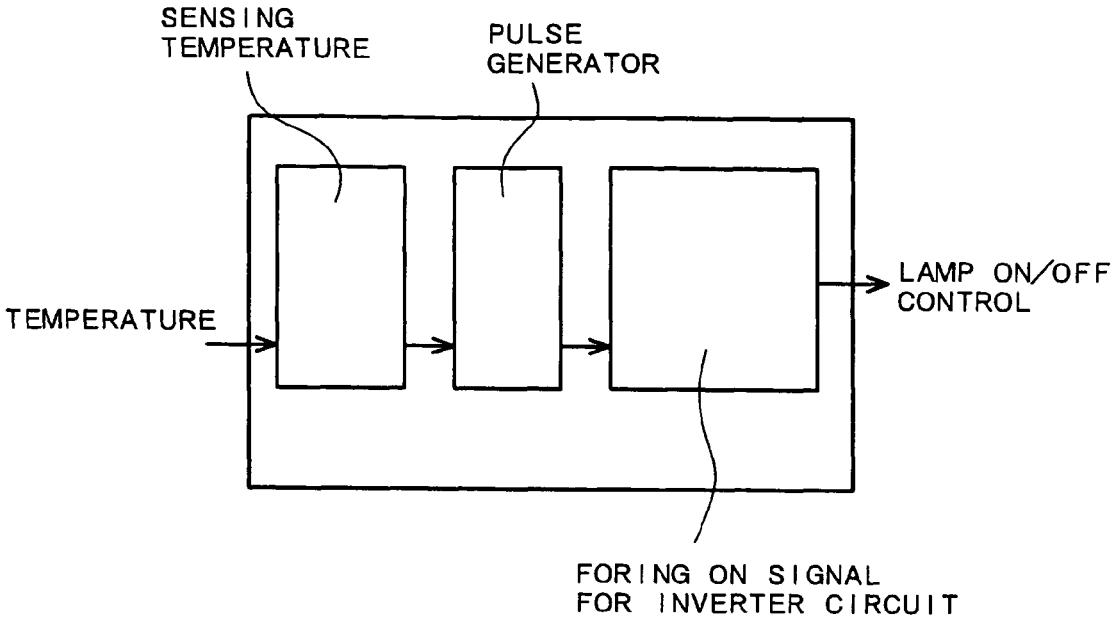
FIG. 35 is an explanatory view for showing another embodiment of the liquid crystal display device according to the invention.

Considering the general characteristics of liquid crystal material which exhibits the low response speed and hence the low discrimination of motion pictures at a low temperature and exhibits the fast response speed and hence the high discrimination of motion pictures at a high temperature, the liquid crystal display device may be provided with a circuit shown in FIG. 35A.

In FIG. 35A, the temperature of the liquid crystal is detected by a temperature sensor and a pulse generator generates a pulse in response to the temperature. The generated pulse is inputted into a generator which forms an ON signal for an inverter circuit and an output from the generator is served for the lighting control of the light sources 35.

As the temperature sensor, a thermistor, for example, may be mounted on the liquid crystal display device. The thermistor detects one of a use outer periphery temperature, a surface temperature of the device and a surface temperature of the light source 35 and generates a pulse signal having a duty which corresponds to the temperature.

Figure 35B:
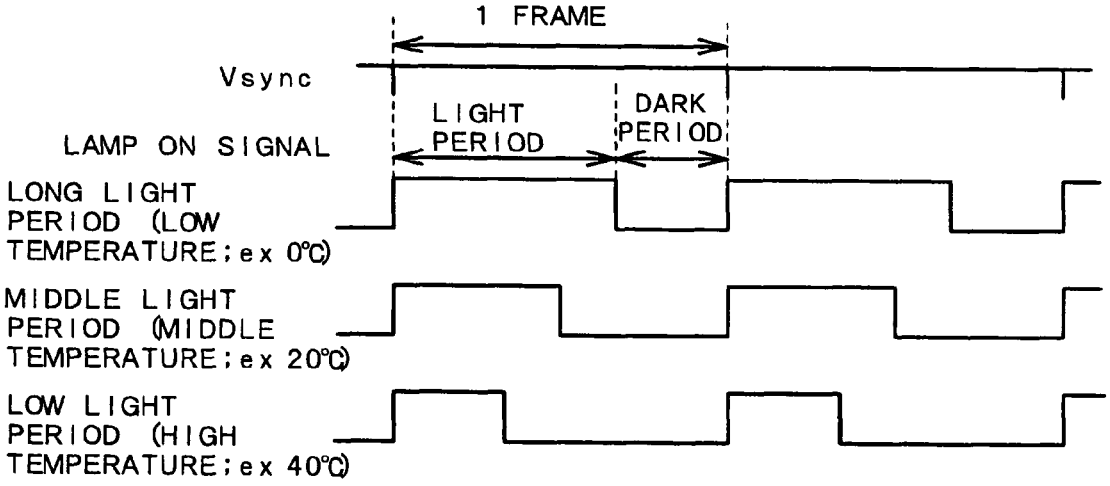

When the temperature is low, the light emitting efficiency of the light sources 35 is low and hence, the duty of the pulse is elongated as shown in FIG. 35(*b*) and a continuous light emission which is similar to a hold-type light emission is rather performed. On the other hand, when the temperature is high, the duty of the pulse is shortened as shown in FIG. 35B.

Alternatively, as another method, in view of the fact that the response speed of the liquid crystal material is low at the low temperature, to avoid the influence of the low response speed, the duty is set small to make the duty approximate a duty of an impulse type light emission which is close to that of a CRT (Cathode Ray Tube). When the response speed of the liquid crystal material is high at the high temperature, the duty may be elongated.

Embodiment 24

As described above, the liquid crystal material generally exhibits the low response speed and hence the low discrimination of motion pictures at a low temperature and exhibits the fast response speed and hence the high discrimination of motion pictures at a high temperature.

This characteristic becomes particularly noticeable during the use period after supplying electricity to the liquid crystal display device. This is because that when a long time (approximately 30 minutes) passes after supplying electricity to the liquid crystal display device, the liquid crystal material exhibits the high temperature due to the heat generation of the light sources 35 and the inverter power source circuit. This implies that the influence of the heat generation is small immediately after the supplying of electricity to the liquid crystal display device and hence, the liquid crystal material is still at the low temperature.

In view of the above, to avoid the influence of the temperature change which takes place along with the lapse of time immediately after the supplying of electricity to the discrimination of motion pictures, the liquid crystal display device may be constituted such that the duty is elongated when the temperature is low immediately after the supplying of electricity so as to rather enable the continuous light emission similar to the hold-type light emission and the duty is shortened when the temperature is high immediately after the lapse of time for the supplying of electricity.

Due to such a constitution, the liquid crystal display device can always perform the display with the constant discrimination of motion pictures from a point of time immediately after the supplying of electricity.

Further, it is needless to say that any one of the constitutions of the embodiments 14 to 24 is, as mentioned above, configured to change over the application and the non-application due to the image processing or the processing which uses a hardware switch or a software switch or the like.

This is because, in such a case, by adopting the full lighting at the time of PC screen and adopting any one of the constitution of the embodiment 14 to 24 at the time of the motion picture screen, it becomes possible to obtain the improvement of the image quality of the still picture and the image quality of the motion picture such that they are compatible with each other at a high level. Particularly, it is effective for reducing flickering at the time of the still picture frame.

Further, the increase of the screen writing frequency at the time of displaying motion picture than at the time of displaying the still picture is also effective to decrease the flickering.

It is needless to say that this does not restrict the technical concepts disclosed in the embodiments 14 to 24 and any constitution which has the state in which the lighting and the extinguishing of the backlight are repeated is effective.

As can be clearly understood from the above-mentioned explanation, according to the liquid crystal display device of the present invention, in spite of the extremely simple constitution, the clear motion picture image can be displayed.

Further, it becomes possible to display the motion picture image which is clear, bright and exhibits the high uniformity.

What is claimed is:

1. A liquid crystal display device having a liquid crystal display panel and a backlight which is arranged on a back surface of the liquid crystal display panel, wherein the backlight includes a plurality of linear light sources which are provided to a surface substantially parallel to a surface of the liquid crystal display panel, are extended in the x direction of the liquid crystal display panel and are arranged in parallel in the y direction, and among respective light sources, at the time of performing the display driving, the light source arranged at a center portion repeats the lighting and the extinguishing and other remaining light sources maintain the lighting, and wherein respective regions which are surrounded by gate signal lines which are extended in the x direction and are arranged in parallel in the y direction and drain signal lines which are extended in the y direction and are arranged in parallel in the x direction on a liquid-crystal-side surface of one of substrates which are arranged to face each other in an opposed manner while sandwiching liquid crystal therebetween are defined as pixel regions and each pixel region is provided with a switching element which is driven by scanning signals from one-side gate signal line and a pixel electrode to which video signals are supplied from the drain signal line through the switching element.

2. A liquid crystal display device having a liquid crystal display panel and a backlight which is arranged on a back surface of the liquid crystal display panel, wherein the backlight includes a plurality of linear light sources which are provided to a surface substantially parallel to a surface of the liquid crystal display panel, are extended in the x direction of the liquid crystal display panel and are arranged in parallel in the y direction, and among respective light sources, at the time of performing the display driving, the light source arranged at a center portion repeats the lighting and the extinguishing and other remaining light sources maintain the lighting, and wherein to a portion which faces a plane determined by the respective light sources which repeat the lighting and the extinguishing out of a liquid crystal display portion formed of a mass of respective pixel regions of the liquid crystal display panel, backlight blinking control means which detects the change of the video signals to the pixel electrodes of the respective pixel regions at the portion and increases the duty of the lighting time in response to the degree of magnitude of the change is provided.

3. A liquid crystal display device having a liquid crystal display panel and a backlight which is arranged on a back surface of the liquid crystal display panel, wherein the backlight includes a plurality of linear light sources which are provided to a surface substantially parallel to a surface of the liquid crystal display panel, are extended in the x direction of the liquid crystal display panel and are arranged in parallel in the y direction, and among respective light sources, at the time of performing the display driving, the light source arranged at a center portion repeats the lighting and the extinguishing and other remaining light sources maintain the lighting, and wherein the liquid crystal display device includes a mode which enables the display of a motion picture and a still picture by changing over them and the lighting and the extinguishing of the backlight are repeated in the motion picture display mode.

4. A liquid crystal display device having a liquid crystal display panel in which respective pixel groups to which video signals are supplied are selected in response to scanning signals supplied to gate signal lines and a backlight which is arranged on a back surface of the liquid crystal display panel, wherein the backlight includes a plurality of linear light sources which are provided to a surface substantially parallel to a surface of the liquid crystal display panel, are extended in the direction parallel to the gate signal lines and are arranged in parallel in the direction which intersects the direction parallel to the gate signal lines, and the light source arranged at least at a center portion repeats the lighting and the extinguishing and the light source disposed at least at one of both sides of the center portion maintains the lighting, and wherein the liquid crystal display device includes a mode which enables the display of a motion picture and a still picture by changing over them and the lighting and the extinguishing of the backlight are repeated in the motion picture display mode.

* * * * *